US006246843B1

(12) United States Patent
Nanataki et al.

(10) Patent No.: US 6,246,843 B1
(45) Date of Patent: Jun. 12, 2001

(54) IMAGE HEATING APPARATUS

(75) Inventors: Hideo Nanataki, Yokohama; Hiroshi Mano, Numazu; Tetsuya Sano, Shizuoka-ken; Minoru Hayasaki; Takashi Nomura, both of Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/557,957

(22) Filed: Apr. 25, 2000

(30) Foreign Application Priority Data

Apr. 27, 1999 (JP) ..... 11-119635
Jul. 30, 1999 (JP) ..... 11-217784

(51) Int. Cl.[7] ..... G03G 15/00
(52) U.S. Cl. ..... 399/45; 399/334; 219/216
(58) Field of Search ..... 399/320, 328, 399/330, 334, 335, 45; 219/216, 619, 670, 671, 672

(56) References Cited

U.S. PATENT DOCUMENTS

| | | | | |
|---|---|---|---|---|
| 5,331,385 | | 7/1994 | Ohstuka et al. | 355/290 |
| 5,801,359 | | 9/1998 | Mano et al. | 219/667 |
| 5,819,150 | | 10/1998 | Hayasaki et al. | 399/330 |
| 5,822,669 | * | 10/1998 | Okabayashi et al. | 399/330 |
| 5,881,349 | | 3/1999 | Nanataki et al. | 399/328 |
| 5,940,655 | | 8/1999 | Sano et al. | 399/69 |
| 5,970,299 | | 10/1999 | Sano et al. | 399/330 |
| 6,031,215 | | 2/2000 | Nanataki et al. | 219/619 |
| 6,037,576 | * | 3/2000 | Okabayashi et al. | 219/619 |
| 6,049,691 | | 4/2000 | Abe et al. | 399/330 |
| 6,078,781 | * | 6/2000 | Takagi et al. | 399/330 |
| 6,122,477 | * | 9/2000 | Parker | 399/330 |

FOREIGN PATENT DOCUMENTS

| | | |
|---|---|---|
| 4-166966 | 6/1992 | (JP) . |
| 5-9027 | 2/1993 | (JP) . |
| 9-171889 | 6/1997 | (JP) . |

* cited by examiner

*Primary Examiner*—Robert Beatty
(74) *Attorney, Agent, or Firm*—Fitzpatrick, Cella, Harper & Scinto

(57) ABSTRACT

The present invention relates to an image heating apparatus which has magnetic flux generating device, a heat generating body for electromagnetically inductively generating heat due to an operation of a magnetic flux generated by the magnetic flux generating device, a conductor provided so as to surround a part of the magnetic flux generated by the magnetic flux generating device, switching device which is connected to the conductor and which can form an electrically closed circuit by using the conductor, and control device for controlling an ON/OFF ratio of the switching device in accordance with a kind of a recording material.

20 Claims, 20 Drawing Sheets

IMAGE HEATING APPARATUS

BACKGROUND OF THE INVENTION

1. Field of the Invention

The present invention relates to an image heating apparatus that is the optimum one used as a fixing device of an image forming apparatus such as a copying machine, a printer, or a facsimile device and, more particularly, to an image heating apparatus utilizing the principle of electromagnetic induction.

2. Related Background Art

An image heating apparatus in an image forming apparatus is an apparatus for fixing a toner image on the surface of a recording material as a permanent fixed image by heating, the toner image being formed on the surface of the recording material in a direct or indirect (transfer) manner by using a toner (visualizing agent) composed of a heat melting resin through proper image formation processing means of electrophotographic, electrostatic recording, or magnetic recording in an image forming portion of the image forming apparatus.

Hitherto, as such an image heat fixing apparatus, a heat roller type one and a film heating type one have been put into practical use. In recent years, an apparatus of an electromagnetic induction heating type has been proposed. Particularly, an image heating apparatus of the electromagnetic induction type has high heat transfer efficiency from a heat source to the toner because a rotating element itself which is come into contact with the recording material can be allowed to generate heat. The apparatus is received attention.

The electromagnetic induction heating type apparatus uses an electromagnetic induction heat generating element as a heating element, operates magnetic field generating means so that a magnetic field acts on the electromagnetic induction heat generating element to generate an eddy current in the electromagnetic induction heat generating element, and thermally fixes the toner on the surface of the recording material as a heating material by Joule heat based on the eddy current.

In Japanese Patent Publication No. 5-9027, disclosed is an apparatus for electromagnetic-induction heating a fixing roller made of a ferromagnetic material. A heating position can be close to a fixing nip portion. Such an apparatus realizes a fixing process with high efficiency that is higher than that of the heat roller type apparatus utilizing a halogen lamp as a heat source.

In Japanese Patent Application Laid-Open No. 4-166966, disclosed is an electromagnetic induction heating type fixing apparatus using a film-shaped rotating element in which the heat capacity is reduced. Since the film itself, which is come into contact with toner, generates heat and the heat capacity is smaller than that of the aforementioned fixing roller, the apparatus has remarkably high efficiency.

In each of the above heating type apparatuses, when a plurality of recording materials are continuously printed, a temperature in a non-sheet passing portion rises. Particularly, in the apparatus using the film-shaped rotating element whose heat capacity is reduced, heat conduction in the longitudinal direction (longitudinal direction of the fixing nip portion) is small. When small-sized recording materials are continuously passed, excess temperature rise occurs in the non-sheet passing portion. Accordingly, there is such a problem that the operating life of a film or a pressurizing roller is deteriorated.

As a method of solving the above problem, there is considered a method whereby in case of using a small-sized recording material, a cooling time for a fixing film is set by extending a sheet feeding interval to reduce the throughput (the number of passing sheets per unit time). In order to obtain the necessary cooling time, there is such a problem that the inherent image forming speed of the apparatus is remarkably deteriorated.

As for the electromagnetic heating system, there is considered a method of preventing the temperature rise in the non-sheet passing portion in such a manner that the magnetic field generating means is divided and arranged to the fixing nip portion in the longitudinal direction, and the divided means are individually operated to perform partial excitation so that a heating area is limited. The apparatus having a large number of magnetic field generating means has a complicated structure and has many problems such that it is necessary to adjust excitation phase of each of the plurality of magnetic field generating means. There is also such a problem that the cost is increased.

The present applicant has proposed such an art that one excitation coil allows a fixing rotating element to generate heat in the longitudinal direction and a conductor for demagnetization is arranged in the non-sheet passing portion to suppress heat generation in the non-sheet passing portion of the rotating element in low costs in Japanese Patent Application Laid-Open No. 9-171889.

According to the present invention, the above art is further improved to provide an apparatus which is applicable to recording materials of various sizes and various thicknesses.

SUMMARY OF THE INVENTION

The present invention is made in consideration of the above problems and it is an object of the present invention to provide an image heating apparatus which can suppress excess temperature rise in a non-sheet passing portion.

Another object of the present invention is to provide an image heating apparatus comprising:

magnetic flux generating means;

a heat generating body for electromagnetically inductively generating heat due to the action of a magnetic flux generated by the magnetic flux generating means;

a conductor which is provided so as to surround a part of the magnetic flux generated by the magnetic flux generating means;

switching means which is connected to the conductor and which can form an electric closed circuit by using the conductor; and control means for controlling the ON/OFF ratio of the switching means in accordance with the kind of a recording material.

The above and other objects of the present invention will become apparent from the following detailed description with reference to the accompanying drawings.

DETAILED DESCRIPTION OF THE PREFERRED EMBODIMENTS

Embodiment 1 (FIGS. 1 to 5, 6A and 6B, 11A and 11B)

(1) Example of Image Forming Apparatus

Figure 1:
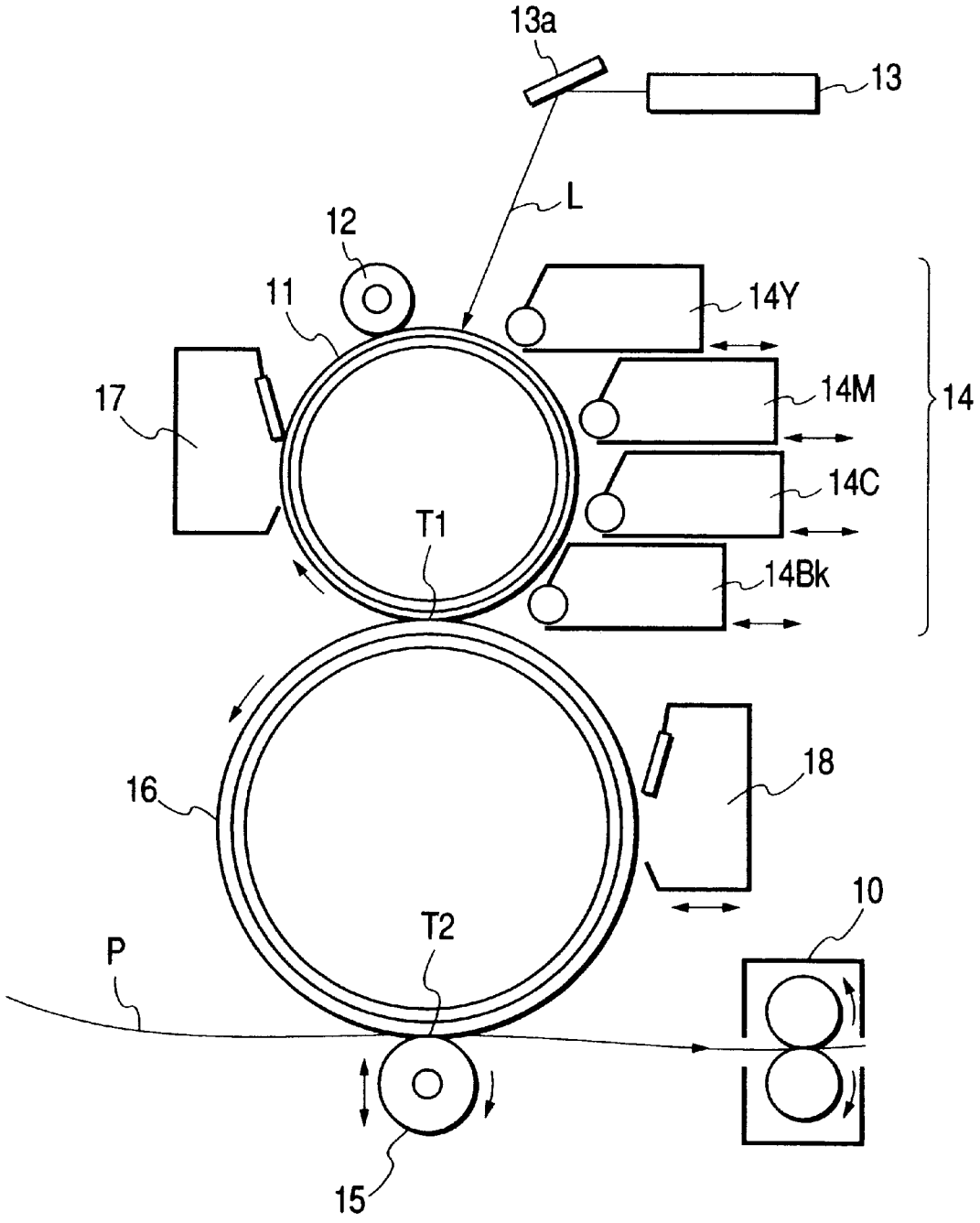
FIG. 1 is a schematic constructional view of an image forming apparatus in an embodiment 1.
Figure 5:
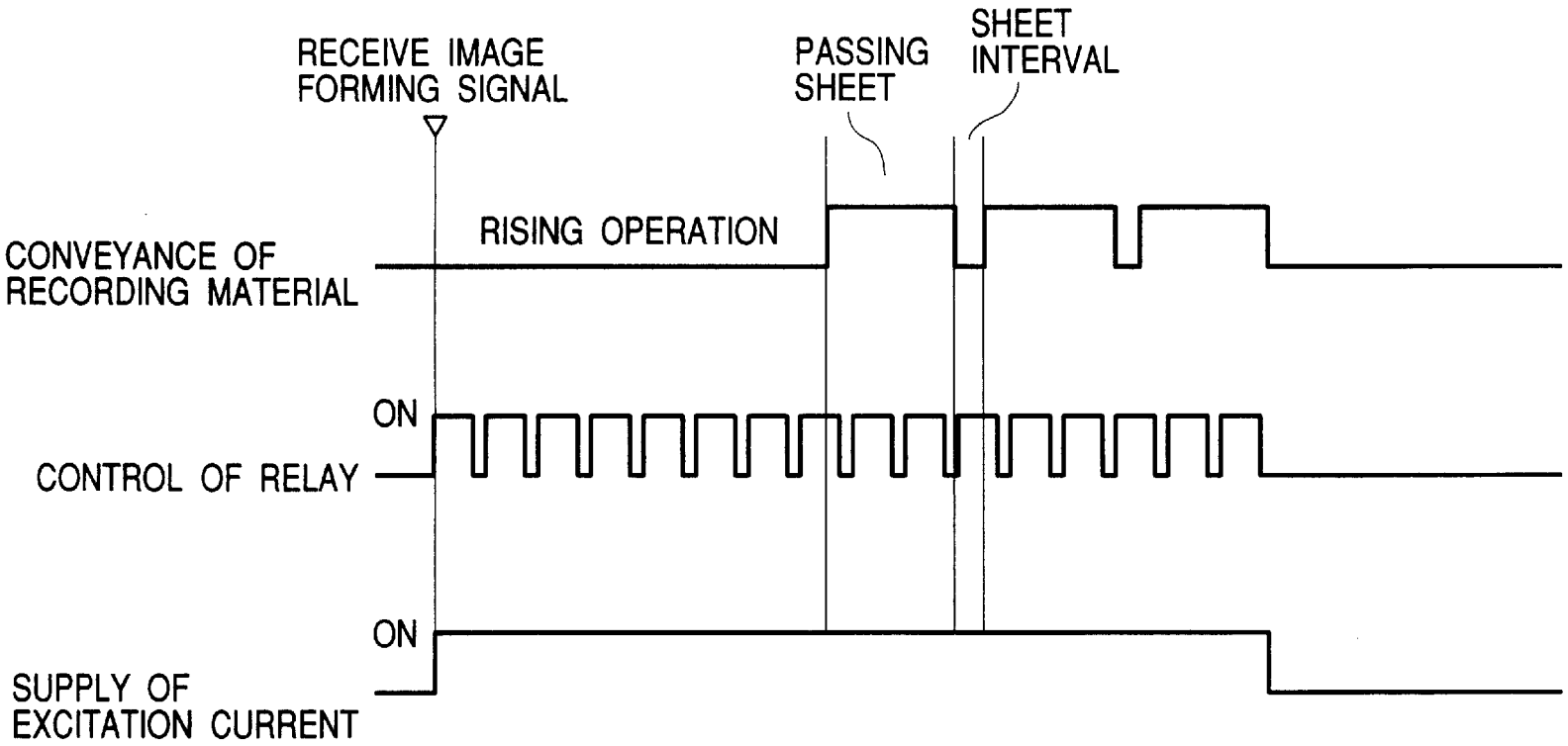
FIG. 5 is a diagram showing a control sequence of an image heat fixing apparatus.

FIG. 1 is a schematic constructional diagram of an example of an image forming apparatus and FIG. 5 is a diagram showing a control sequence of a heating fixing apparatus in the image forming apparatus. The image forming apparatus of the present example is an electrophotographic full-color printer.

An electrophotographic photosensitive drum (image bearing member) 11 composed of an organic photosensitive member is rotatably driven in the clockwise direction shown by an arrow at a predetermined processing speed (peripheral velocity).

The photosensitive drum 11 is subjected to a uniform charging process with predetermined polarity and potential by a charging device 12 such as a charging roller in its rotating operation. Subsequently, a scanning exposure process based on image information by a laser beam L generated from a laser optical box (laser scanner) 13 is performed to the charged surface of the drum. The laser optical box 13 generates the laser beam L which is modulated (turned on/off) in response to a time-sequence electric digital pixel signal regarding the image information from an image signal generating apparatus such as a computer (not shown) to scan and expose the surface of the photosensitive drum. An electrostatic latent image corresponding to the image information is formed on the surface of the photosensitive drum 11 by the scanning exposure. A mirror 13*a* reflects the output laser beam from the laser optical box 13 to an exposing position of the photosensitive drum 11.

In case of forming a full-color image, the scanning exposure and latent image formation are performed with respect to a first color separation component image of a target full-color image, for example, a yellow component image. The latent image is developed as a yellow toner image by the operation of a yellow developing device 14Y included in a four-color image forming device 14. The yellow toner image is transferred onto the surface of an intermediate transfer drum 16 in a primary transfer portion T1 as a contact portion (or closing portion) between the photosensitive drum 11 and the intermediate transfer drum 16. After the toner image is transferred onto the surface of the intermediate transfer drum 16, the surface of the photosensitive drum 11 is cleaned so that adhered residue such as transfer residual toner is removed by a cleaner 17.

The above-mentioned processing cycle including charging, scanning exposure, development, primary transfer, and cleaning is sequentially executed to each of second (for example, a magenta component image developed by a magenta developing device 14M), third (e.g., a cyan component image developed by a cyan developing device 14C), and fourth (e.g., a black component image developed by a black developing device 14B) color separation component images. The yellow toner image, magenta toner image, cyan toner image, and black toner image, namely, the toner images of four colors in total are transferred so as to be sequentially superposed onto the surface of the intermediate transfer drum 16, so that a color image corresponding to the target full-color image is formed so as to be synthesized.

The intermediate transfer drum 16 comprises a metallic drum, a middle-resistant elastic layer laminated on the metallic drum, and a high-resistant surface layer laminated on the elastic layer. The transfer drum 16 is rotatably driven so as to be in contact with or close to the photosensitive drum 11 in the counterclockwise direction shown by an arrow at almost the same peripheral velocity as that of the drum 11. A bias potential is applied to the metallic drum to transfer the toner image on the photosensitive drum 11 side onto the surface of the intermediate transfer drum 16 due to the potential difference between the two drums.

In a secondary transfer portion T2 as a contact nip portion between the intermediate transfer drum 16 and a transfer roller 15, the color toner image synthesized on the intermediate transfer drum 16 is transferred onto the surface of a recording material P which is fed out of a sheet feeding portion (not shown) to the secondary transfer portion T2 at a predetermined timing. The transfer roller 15 supplies charges of a polarity opposite to that of the toner from the rear surface of the recording material P to transfer the synthesized color toner image from the intermediate transfer drum 16 side onto the recording material P side in a lump.

The recording material P passed through the secondary transfer portion T2 is separated from the surface of the intermediate transfer drum 16 and introduced to an image heat fixing apparatus 10. The unfixed toner image is fixed to the material P by heating. The material P as a material on which the color image is formed is discharged to an external delivery tray (not shown).

The image heat fixing apparatus 10 is an apparatus of an electromagnetic induction heating system according to the present invention. The fixing apparatus 10 will now be described in detail in the following item (2).

After the color toner image is transferred onto the recording material P, the intermediate transfer drum 16 is cleaned so that the adhered residue such as transfer residual toner or paper dusts is removed by a cleaner 18. The cleaner 18 is normally held so as to be away form the intermediate transfer drum 16. In the secondary transfer executing process in which the color toner image is transferred from the intermediate transfer drum 16 onto the recording material P, the cleaner 18 is held so as to be come into contact with the intermediate transfer drum 16.

The transfer roller 15 is generally also held so as to be away from the intermediate transfer drum 16. In the secondary transfer executing process of the color toner image from the intermediate transfer drum 16 to the recording material P, the roller is held so as to be come into contact with the intermediate transfer drum 16.

Information regarding the recording paper P (sheet size, sheet thickness, or special sheet information) can be added to the image information from the image signal generating apparatus such as a computer (not shown). In the image forming apparatus, the adapted recording material P is selected in the sheet feeding portion (not shown) on the basis of the information and the above-mentioned sheet feeding operation is performed. The information regarding the recording material is stored into a storing apparatus in the apparatus and used as parameters to control the image heat fixing apparatus 10 which will be described later.

(2) Image Heating Fixing Apparatus 10

Figure 2:
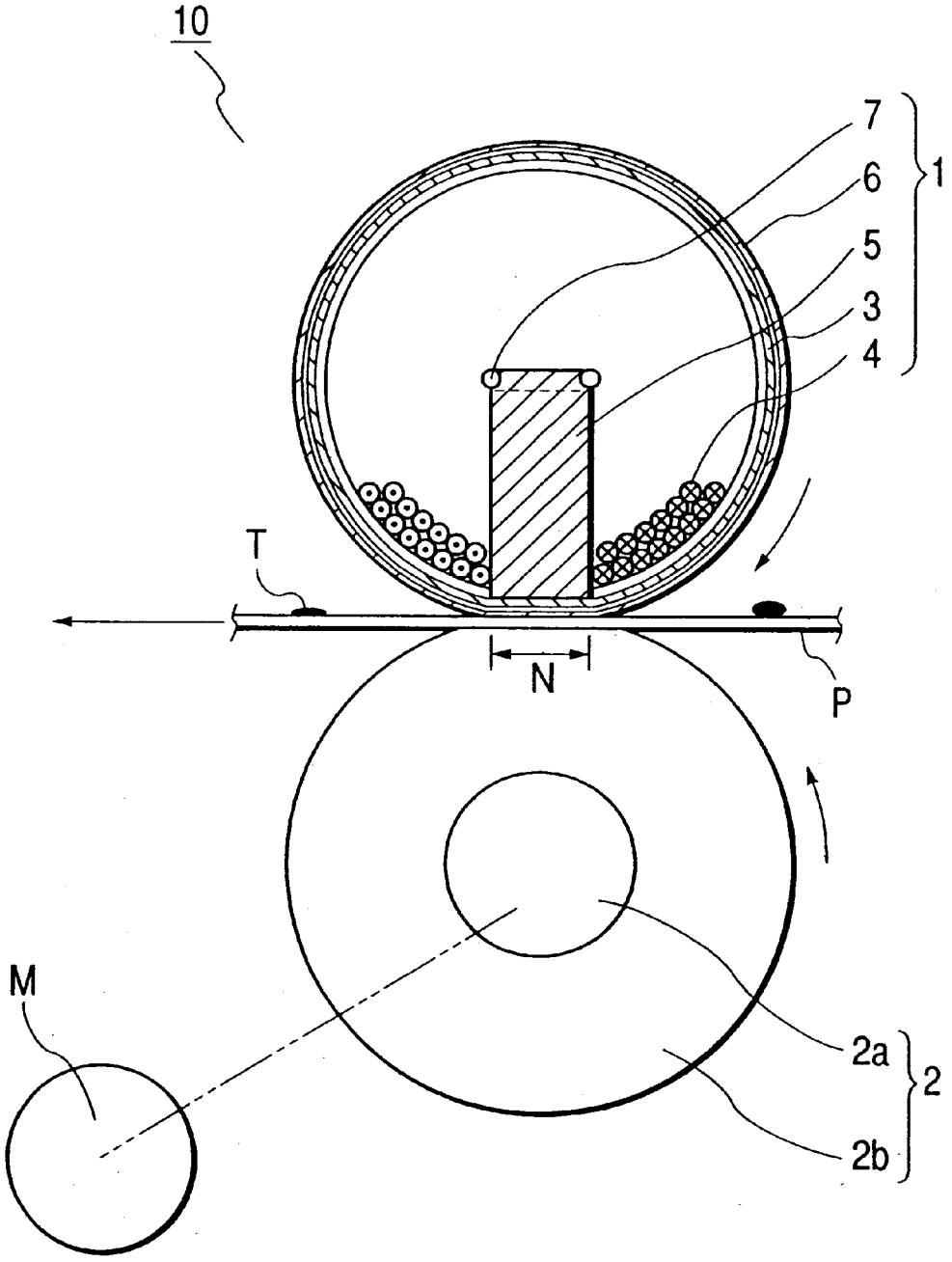
FIG. 2 is a partially cutaway schematic side view of an image heating fixing apparatus.
Figure 3:
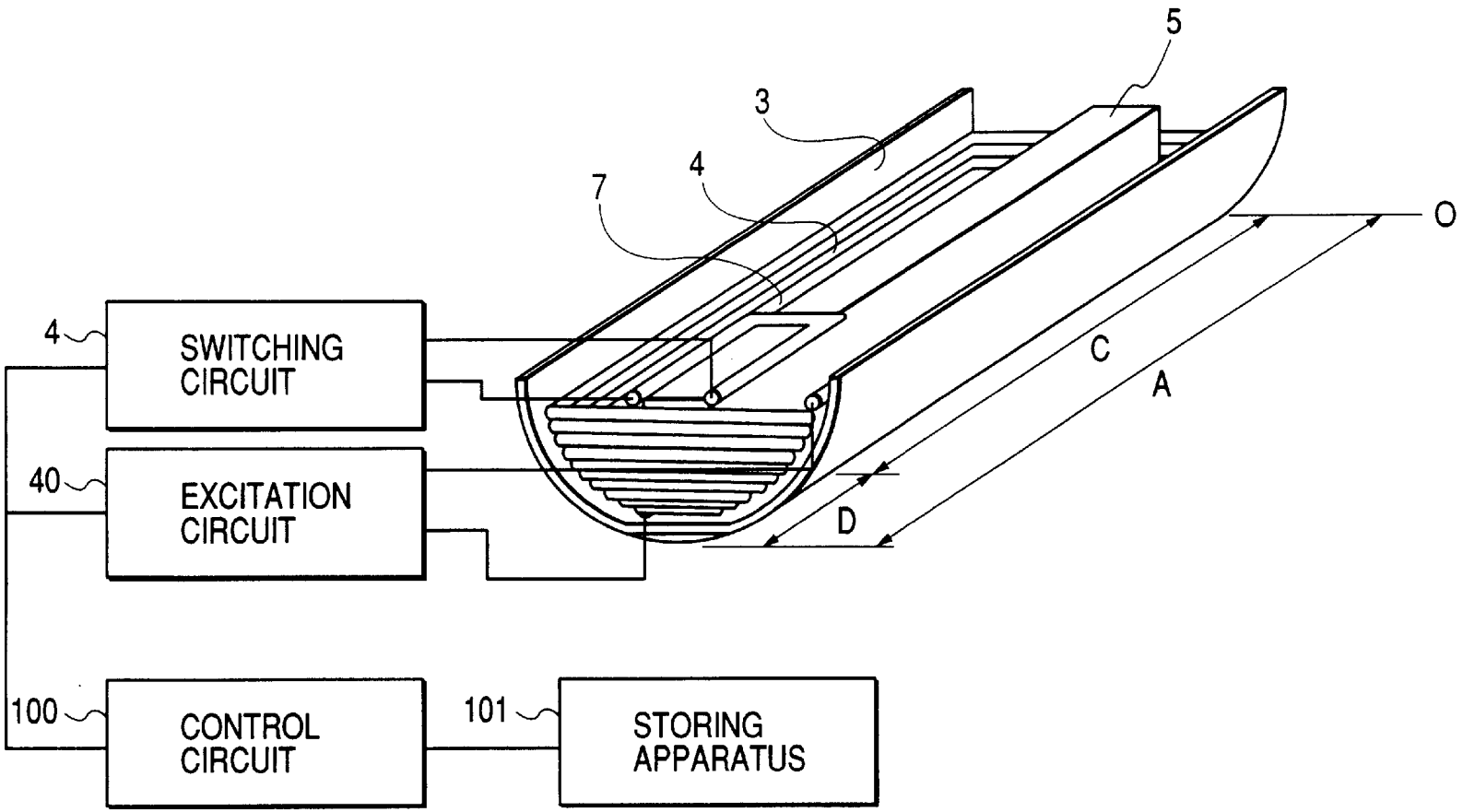
FIG. 3 is a cutaway perspective view of a heating assembly.

FIG. 2 is a partially cutaway side model view of the image heating fixing apparatus 10 and FIG. 3 is a cutaway perspective view of a heating assembly.

The fixing apparatus 10 comprises a heating assembly 1 and a pressurizing roller 2 as a rotary pressurizing member as main components.

The heating assembly 1 comprises: a cylindrical film guide 3; an excitation coil 4 and a magnetic core (high-permeability core) 5 as magnetic flux generating means disposed in the internal space of the guide; a cylindrical (seamless) fixing film 6 as an induction heat generating body (element) that is loosely fitted around the cylindrical film guide; and a ring conductor 7 as electroconductor surrounding a part of the magnetic core 5.

The pressurizing roller 2 is an elastic roller comprising a core 2*a* and a silicone rubber layer 2*b* having a thickness of 2 mm, which covers the periphery of the core.

The above-mentioned heating assembly 1 and pressurizing roller 2 are built in the apparatus housing (not shown) so that they are longitudinally pressed in contact with each other. A fixing nip (heating nip) portion N having a predetermined width is formed between the assembly 1 and the roller 2. In the fixing nip portion N, the internal surface of the fixing film 6 is tightly come into contact with the bottom surface of the cylindrical film guide member 3.

The pressurizing roller 2 is rotatably driven by driving means M in the counterclockwise direction as shown by an arrow in FIG. 2. A frictional force caused by the rotation driving of the pressurizing roller 2 operates on the fixing nip portion N between the roller 2 and the external surface of the fixing film 6, so that the fixing film 6 is rotated in a driven manner around the cylindrical film guide member 3 in the clockwise direction as shown by an arrow.

The excitation coil 4 generates an alternating magnetic flux due to an alternating current which is supplied from an excitation circuit 40 (FIG. 3). The alternating magnetic flux is induced to the magnetic core 5 to generate an eddy current in an electromagnetic induction heat generating layer, which will be described later, of the fixing film 6. The eddy current utilizes the specific resistance of the electromagnetic induction heat generating layer to produce Joule heat. In other words, the alternating current is supplied to the excitation coil 4, so that the fixing film 6 enters an electromagnetic induction heat generating state.

A control circuit 100 including temperature detecting means (not shown) controls the alternating current to be supplied from the excitation circuit 40 to the excitation coil 4 to control a temperature in the fixing nip portion N to a predetermined fixing temperature.

The alternating current is supplied to the fixing film 6 and the temperature of the fixing nip portion N is raised to a predetermined temperature. In such a temperature adjusting state, when the recording material P bearing an unfixed toner image t, serving as a material to be heated, is introduced to the nip portion N between the rotary fixing film 6 and the pressurizing roller 2, the recording material P is tightly adhered onto the external surface of the fixing film 6 and passes through the fixing nip portion N together with the fixing film 6. During the passage through the fixing nip portion, the recording material P and the unfixed toner image t are heated by heat generated in the fixing film 6 which is electromagnetically induction heated to fix the toner image by the heat. The recording material P passed through the fixing nip portion N is separated from the external surface of the fixing film 6 on the separating side of the fixing nip portion N.

a. In the heating assembly 1, the cylindrical film guide member 3 is composed of an insulating heat-resistant material that does not obstruct the transmission of the magnetic flux. The guide member 3 supports the excitation coil 4 and magnetic core 5 and also guides the internal surface of the fixing film 6 rotating around the member 3 to stabilize the rotation of the fixing film 6.
b. As an excitation coil 4 of the present embodiment, an insulated covering coil is used. The coil is wound so as to be long in the lateral direction in a boat-like shape substantially corresponding to the shape of the internal surface of the cylindrical film guide member 3. The coil is inserted and arranged so that the wound coil is received on almost the half portion on the lower side in the internal space of the cylindrical film guide member 3.

The excitation coil 4 must generate an alternating magnetic flux enough to heat. Therefore, the coil needs to have a low resistance component and a high inductance component. In the present embodiment, an insulated covering coil having diameter of 1 mm (ϕ1) for high frequency, in which a fine wire is fluxed as a core wire, is used as a coil. The coil is wound 12 times so as to surround the fixing nip portion N to construct the excitation coil 4. The excitation circuit 40 is connected to the excitation coil 4. The excitation circuit 40 can supply an alternating current of 50 kHz to the excitation coil 4.

c. The magnetic core 5 is a ferrite core that is long in the lateral direction. The core is arranged on substantially the center of the excitation coil 4 wound in a boat-like shape so as to be supported by the cylindrical film guide member 3. The magnetic core 5 efficiently induces the alternating magnetic flux generated by the excitation coil 4 to the fixing film 6.

d. The fixing film 6 is a cylindrical member including the electromagnetic induction heat generating layer. The film 6 is formed so that the internal diameter of the film is slightly larger than the outer diameter of the film guide member 3. Accordingly, it is loosely fitted around the cylindrical film guide member 3.

Figure 4A:
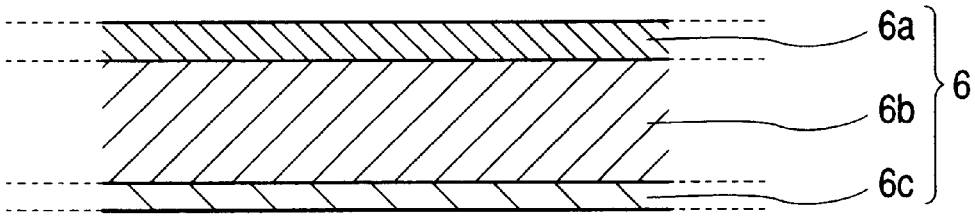
FIGS. 4A and 4B are layer constructional model view of fixing films (induction heat generating films)

FIG. 4A is a layer constructional model view of the fixing film 6. The fixing film 6 according to the present embodiment has a three-layer composite layer construction comprising: an electromagnetic induction heat generating layer 6*a* on the internal side (adjacent to the cylindrical film guide member 3); an elastic layer 6*b* laminated on the layer 6*a*; and a mold releasing layer 6*c* (surface layer on the pressurizing roller 2 side) laminated on the layer 6*b*. Heat generated in the electromagnetic induction heat generating layer 6*a* is transferred to the recording material P conveyed through the fixing nip portion N via the elastic layer 6*b* and the mold releasing layer 6*c*, so that the recording material P and the toner image t on the recording material are heated.

The heat generating layer 6*a* is a layer composed of a material having electromagnetic induction heat generating properties to generate Joule heat due to the eddy current produced by the action of the alternating magnetic flux. Preferably, metal such as nickel as an electric good conductor of $10^{-5}$ to $10^{-10}$ Ω•m, a metallic compound, or an organic conductor, more preferably, iron as a ferromagnetic material having high permeability, pure metal such as cobalt, or a compound of them can be used.

When the thickness of the heat generating layer 6*a* is too thin, an enough magnetic path cannot be assured. The magnetic flux leaks to the outside to reduce an heat generation energy of the heat generating element itself in some cases. On the contrary, when it is too thick, the heat capacity increases, so that there is a tendency to extend a time required for raising the temperature. Therefore, the optimum value of the thickness is determined depending on values of the specific heat, density, permeability, and resistivity of the material used as a heat generating layer 6*a*. Actually, in case of operating as a heat fixing apparatus, within a range of 10 to 100 μm as a thickness of the heat generating layer, a heating rate of 3 deg/sec or more could be obtained as a surface temperature of the fixing film 6.

The elastic layer 6*b* is a rubber layer made of silicone rubber. In the present embodiment, it is provided in order to favorably fix a color toner image composed of the maximum four toner layers. The elastic layer receives the toner image with its elastic properties to uniformly melt it.

When the hardness of the elastic layer 6*b* is too high, the layer 6*b* cannot be adapted to the uneven surface of the recording material or the toner layers, so that a variation in image gloss occurs. Consequently, the hardness of the elastic layer 6*b* is preferably set to 60° (JIS-A) or less, more preferably, 45° (JIS-A) or less.

The heat conductivity λ of the elastic layer 6*b* is preferably set to $6\times10^{4}$ [cal/cm•sec•deg.] ($6\times10^{-4}\times4.186=2.512\times10^{-3}$ [J/cm•sec•deg.]) to $2\times10^{-3}$ [cal/cm•sec•deg.] ($8.372\times10^{-3}$ [J/cm•sec•deg.]). When the heat conductivity λ is smaller than $6\times10^{-4}$ [(cal/cm•sec•deg.], the heat resistance is large to lower the heating rate in the surface layer of the fixing film.

The thickness of the elastic layer 6*b* is preferably set to 100 to 300 μm. When it is smaller than 100 μm, in the case that the proportion of solid images is high as in the color image forming apparatus, a dotted variation in gloss easily occurs. When it is larger than 300 μm, large thermal gradient occurs between the surface of the elastic layer 6*b* and the heat generating layer 6*a*, so that heat deterioration in the elastic layer is easily caused.

The mold releasing layer 6*c* prevents the toner from adhering to the surface of the fixing film. A material having good mold releasing properties and heat-resistant properties, such as fluoroplastic such as PFA, PTFE, or FEP, silicone resin, silicone rubber, or fluororubber can be selected.

The thickness of the mold releasing layer 6*c* is preferably set to 20 to 100 μm. When it is smaller than 20 μm, such a problem that a portion with bad mold releasing properties is formed and the durability is insufficient because of coating evenness in the layer made by coating occurs. When it is larger than 100 μm, such a problem that the heat conductivity is deteriorated occurs. Particularly, in case of the mold releasing layer made of the resin system, the hardness is too high and the elastic layer 6*b* is not effective.

The fixing film 6 used in the present embodiment is a three-layer composite film comprising the heat generating layer 6*a* composed of nickel, having a thickness of 50 μm, elastic layer 6*b* composed of silicone rubber, having a thickness of 300 μm, and mold releasing layer 6*c* composed of fluoroplastic, having a thickness of 30 μm.

Figure 4B:
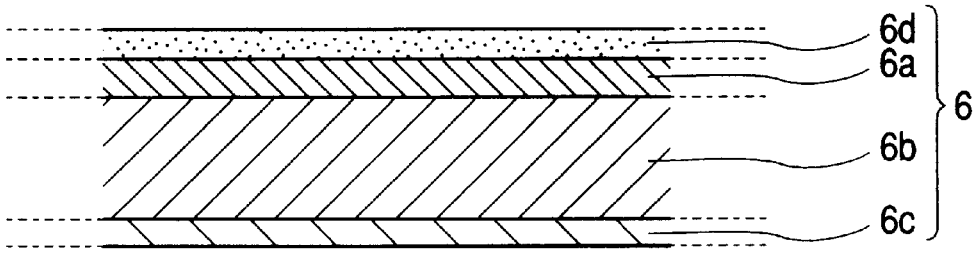

As shown in FIG. 4B, as a fixing film 6, a film with a four-layer structure in which a heat-resistant layer 6*d* is formed on the upper surface of the heat generating layer 6*a* in the above-mentioned layer structure of the fixing film 6 can be also used. As a heat-resistant layer 6*d*, a heat-resistant resin such as fluoroplastic, polyimide resin, polyamide resin, polyamide-imide resin, PEEK resin, PES resin, PPS resin, PFA resin, PTFE resin, or FEP resin may be used. The thickness of the heat-resistant layer 6*d* is preferably set to 10 to 1000 μm. When it is smaller than 10 μm, the heat-resistant effect is not obtained and the durability is insufficient. When it is larger than 1000 μm, the distance between the magnetic core 5 and the heat generating layer 6*a* is increased, so that the magnetic flux does not sufficiently reach the heat generating layer 6*a*. When the heat-resistant layer 6*d* is formed, the temperature rise in the excitation coil 4 and magnetic core 5 due to the heat generated in the heat generating layer 6*a* can be prevented, so that it is possible to stably heat.

e. As a ring conductor 7, an insulated covered electric good conductor is arranged so as to substantially surround a part of the magnetic path generated by the excitation coil 4. Both ends of the conductor are connected to a switching circuit 41 on the outside of the image heat fixing apparatus 10, thereby constructing a closed circuit. In the longitudinal direction of the fixing nip portion N, the ring conductor 7 is arranged on a position to surround the magnetic flux in a non-sheet passing area when the recording material of a minimum regular size available to the apparatus is used and passed.

In the present embodiment, the same material as that of the excitation coil 4 is used as a ring conductor 7. The ring conductor 7 is arranged so as to surround the top surface of the magnetic core 5, corresponding to the non-sheet passing area in the minimum-sized recording material. Since most of the magnetic fluxes generated in the excitation coil 4 pass through the magnetic core 5 as a material with high permeability, most of the magnetic fluxes in the non-sheet passing area can be surrounded by arranging the ring conductor 7 in a part of the magnetic core as mentioned above.

In the present embodiment, introducing the recording material P into the fixing apparatus 10 is performed on the basis of one-side standard sheet passing. Referring to FIG. 3, reference symbol O denotes a one-side sheet passing standard; A a sheet passing area of a recording material of the maximum size (recording material having the maximum width which can be passed through the apparatus); C a sheet passing area of a recording material of the minimum size (recording material having the minimum width which can be passed through the apparatus); and D a non-sheet passing area when the recording material of the minimum size is passed (A–C). In the present embodiment, the ring conductor 7 is arranged over the area D.

The switching circuit 41 used in the present embodiment is a relay having a moving contact. The circuit constructed by the ring conductor 7 is opened or closed by opening or closing the relay. Since the relay has no polarity, there is such an advantage that the switching circuit 41 can be easily constructed.

Figure 11A:
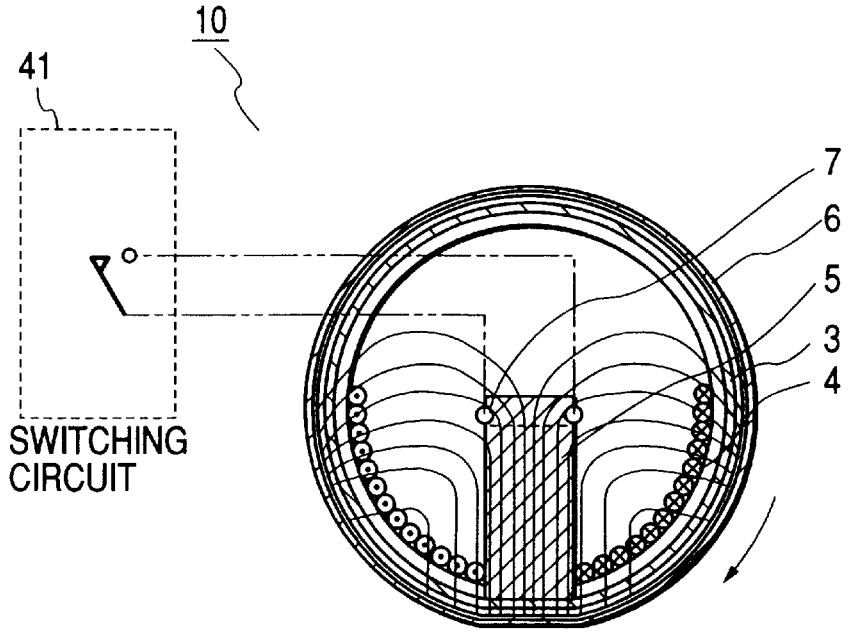
FIG. 11 is a cross-sectional view showing the situation of a magnetic flux when a circuit comprising a ring conductor is released and FIG. 11B is a cross-sectional view showing the situation of the magnetic flux when the circuit comprising the ring conductor is closed.
Figure 11B:
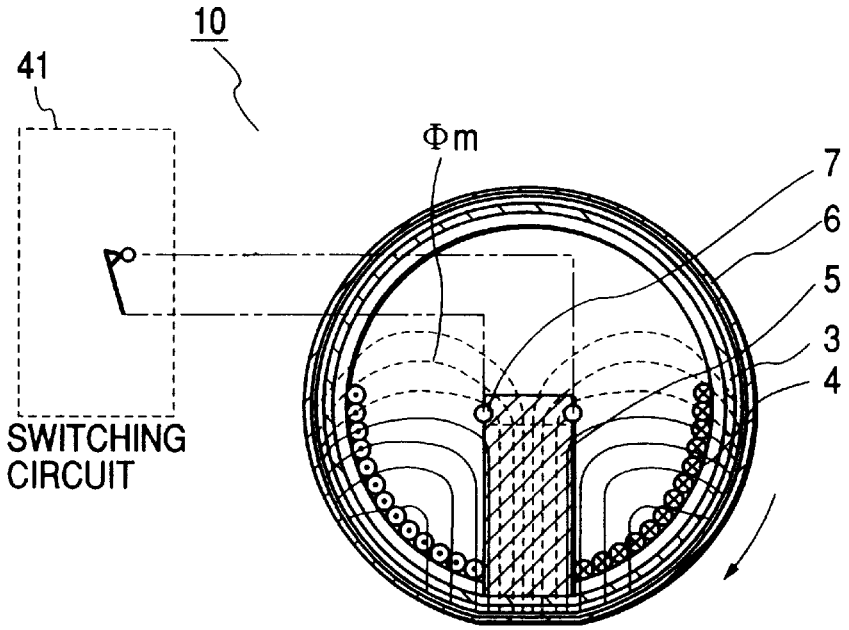

FIGS. 11A and 11B are cross-sectional model views of the heating assembly. The switching circuit 41 is typically shown by using a contact switch for simple description. FIG. 11A schematically shows the state of the magnetic flux in the heating assembly in the OFF state (the relay is opened). FIG. 11B schematically shows it in the ON state (the relay is closed).

According to the Lentz's law, the alternating magnetic flux passing through the closed loop consisting of the conductor 7 and the relay induces an alternating voltage across the ring conductor 7 in the direction to demagnetize the magnetic flux generated by the excitation coil 4. Consequently, when the relay is closed, the alternating current flows through the ring conductor 7 by the induced alternating voltage, so that the magnetic flux to operate on the fixing film 6 is demagnetized in the area where the conductor 7 is arranged. The rate at which the closed loop by the ring conductor 7 demagnetizes the magnetic flux depends on a connection coefficient k of the excitation coil 4 to the ring conductor 7. k is generally expressed as follows.

$$k = \frac{\Phi m}{\{\Phi m^2 + (\Phi l_1 + \Phi l_2)\cdot\Phi m + \Phi l_1 \cdot \Phi l_2\}^{1/2}}$$

where, reference symbol $\phi m$ denotes the magnetic flux which penetrates through both of the excitation coil 4 and the ring conductor 7; $\phi 1_1$ a leak magnetic flux in the excitation coil 4; and $\phi 1_2$ a leak magnetic flux in the ring conductor 7.

In the present embodiment, the magnetic flux passing through the magnetic core 5 in the area where the ring conductor 7 is arranged corresponds to $\phi m$. The magnetic flux passing through a space between the excitation coil 4 and the magnetic core 5 corresponds to $\phi 1_1$ and $\phi 1_2$. In the system in which the space between the excitation coil 4 and the magnetic core 5 is large as shown in the present embodiment, the leak magnetic fluxes $\phi 1_1$ and $\phi 1_2$ are relatively large. As shown in FIG. 11B, therefore, when the ring conductor 7 is closed, the magnetic flux is demagnetized as much as $\phi m$, so that the heating capability is reduced and the fixing film 6 is heated by the leak magnetic flux. Consequently, a temperature in the non-sheet passing area is maintained so as to have smooth continuity with a temperature in the area where the ring conductor 7 is not arranged (sheet passing area).

According to the operation, even when the relay is closed, an extremely temperature difference is not generated in the longitudinal temperature distribution of the fixing film 6 and that of the pressurizing roller 2, so that there is such an effect to prevent deformation or destroy caused by a difference in thermal expansion or the like.

As shown in FIG. 11A, when the relay is opened, the induced current does not flow through the ring conductor 7, so that the magnetic flux generated in the excitation coil 4 is not deteriorated and uniform temperature rising capability can be obtained in the whole area.

In the present embodiment, information regarding the kinds of the recording materials to be used has been stored in a storing apparatus 101. The ratio of the closing operation to the opening operation of the relay is controlled on the basis of the information regarding the size among the above information, so that the excess temperature rise in the non-sheet passing area can be reduced even in the recording material of a size lying within a range of the maximum-sized recording material to the minimum-sized one.

In the present embodiment, the ratio of ON/OFF per control unit time (unit; two seconds in the present embodiment) is set as follows in accordance with the size of the recording material.

TABLE 1

| Size of recording material | A | B1 | B2 | B3 | B4 | C |
|---|---|---|---|---|---|---|
| Width (mm) | 216 | 210 | 182 | 148 | 105 | 98.4 |
| ON ratio (%) | 0 | 0 | 15 | 50 | 90 | 100 |

The control of the ring conductor 7 is started simultaneously with the rising operation of the fixing apparatus 10 at the time that the size of the recording material P is recognized and stored (reception of the image forming signal) until the final recording material is discharged from the fixing nip portion N of the fixing apparatus 10. In other words, during the above period of time, the control is performed in such a manner that the ON/OFF operation is repeated so that the relay is closed only for a period of time corresponding to the ON ratio shown in Table 1 every unit (two seconds).

Figure 6A:
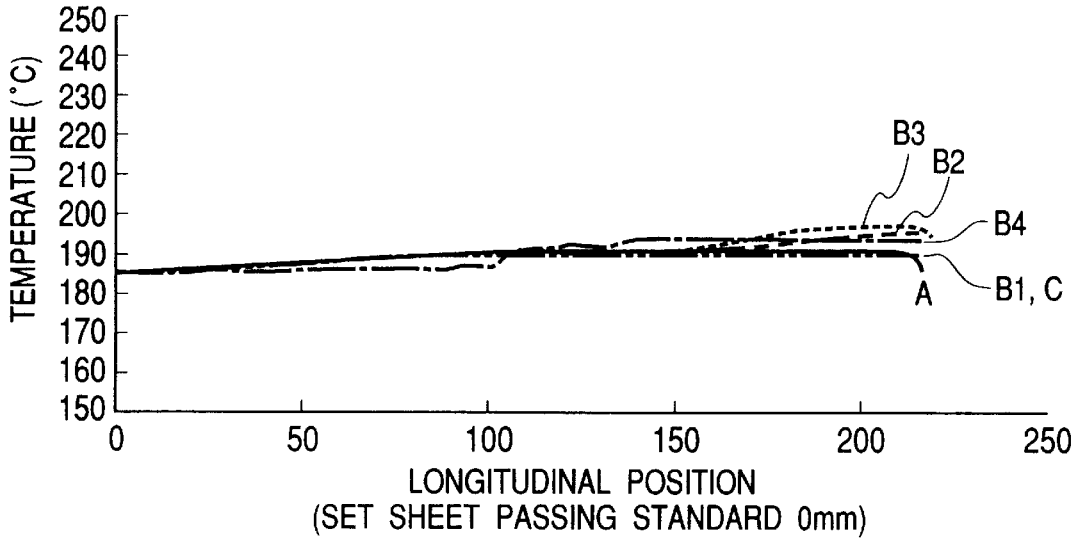
FIG. 6A is a graph showing a longitudinal temperature distribution of a fixing film surface of the embodiment 1 and FIG. 6B is a graph showing a longitudinal temperature distribution of a fixing film surface of a comparative example.
Figure 6B:
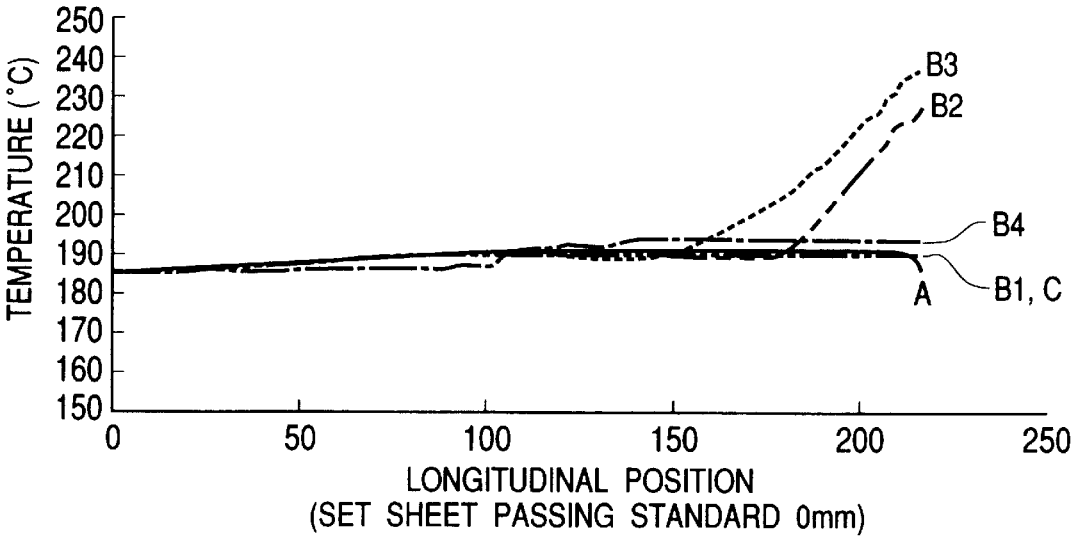

FIG. 6A shows the longitudinal temperature distribution regarding the surface of the fixing film 6 when the recording materials of respective sizes are passed (successive 20 sheets, fixing speed: 100 mm/s, fixing temperature: 190° C.). FIG. 6B shows the longitudinal temperature distribution regarding the surface of the fixing film 6 when the recording materials are passed in the ON or OFF state alone without controlling the ON ratio as shown in Table 2 as a comparative example.

TABLE 2

| Size of recording material | A | B1 | B2 | B3 | B4 | B5 |
|---|---|---|---|---|---|---|
| Width (mm) | 216 | 210 | 182 | 148 | 105 | 98.4 |
| ON ratio (%) | 0 | 0 | 0 | 0 | 100 | 100 |

As shown in the comparison in FIGS. 6A and 6B, the excess temperature rising in the non-sheet passing area for each size is reduced by controlling the ON/OFF ratio. The use heat-resistant temperature of the fixing film 6 used in the present embodiment is 240° C. and that of the pressurizing roller 2 is 220° C. In the comparative example, the temperature exceeds the above use heat-resistant temperatures. Contrarily, in the present embodiment, there is an enough margin up to the heat-resistant temperature.

Owing to the operation, it is unnecessary to provide individual magnetic field generating means in order to adapt to recording materials of various sizes, the inherent throughput of the apparatus is not remarkably deteriorated, and the deterioration of the fixing film 6 because of the excess temperature rise can be prevented, so that high durability and high processing speed of the apparatus can be realized.

The present embodiment has shown the case of using the one-side standard sheet passing system such that the recording material was passed so as to be put to one side in the longitudinal direction. Even in an apparatus using a center standard sheet passing system, the ring conductor 7 is arranged over each of the non-sheet passing areas on both sides, so that the similar effects can be obtained.

The present embodiment has shown the case where the information regarding the recording material was obtained from the external image signal generating apparatus (computer or the like). A sensor of a sheet size detecting mechanism is provided in the apparatus, information detected by the sensor is stored, and the stored information can be used.

In the present embodiment, the case of the four-color image forming apparatus has been described. The present invention is also applicable to a monochromatic image forming apparatus. In this case, the elastic layer 6*b* in the fixing film 6 can be omitted.

Figure 7:
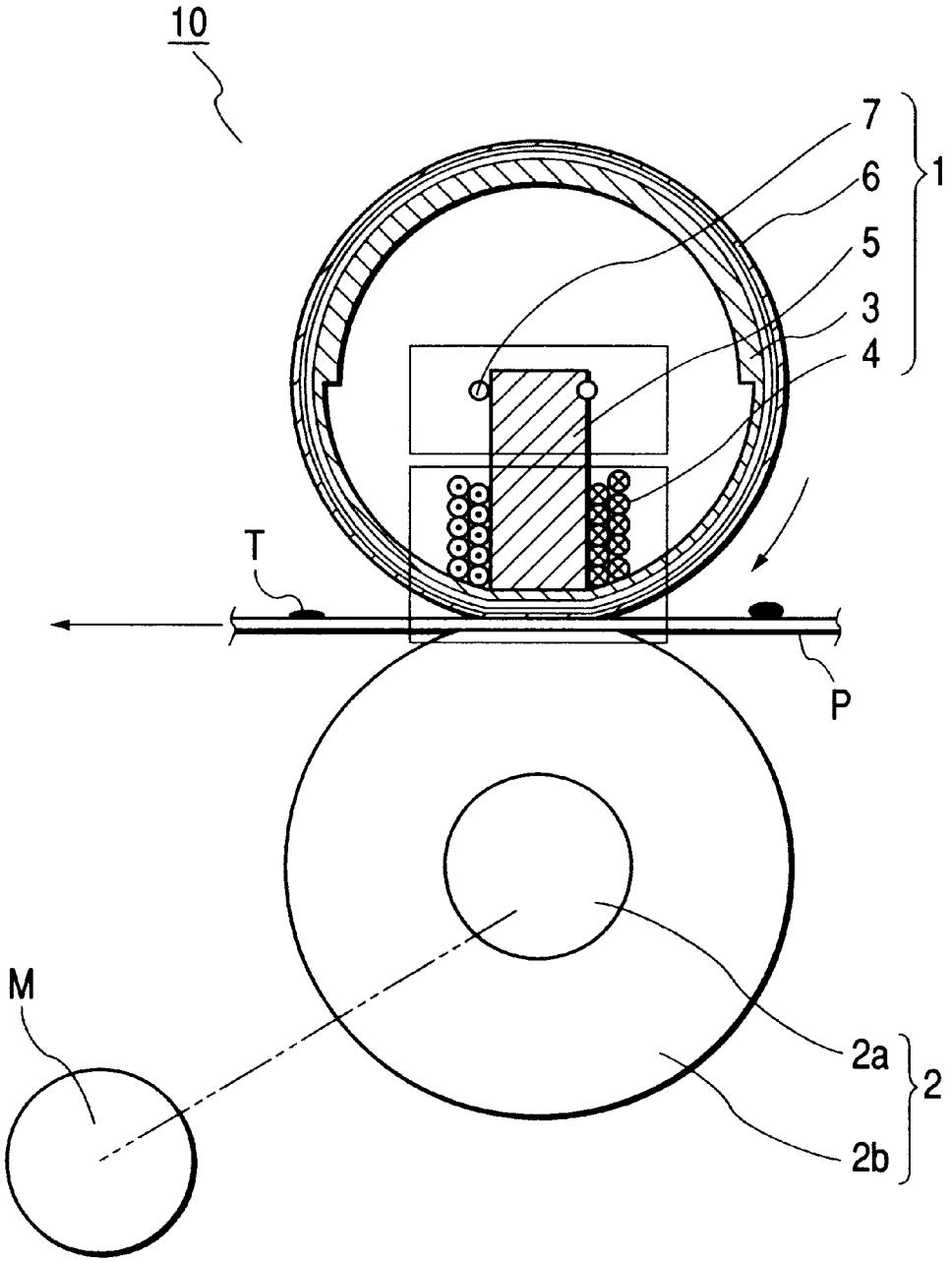
FIG. 7 is a partially cutaway side model view of the image heat fixing apparatus.
Figure 8:
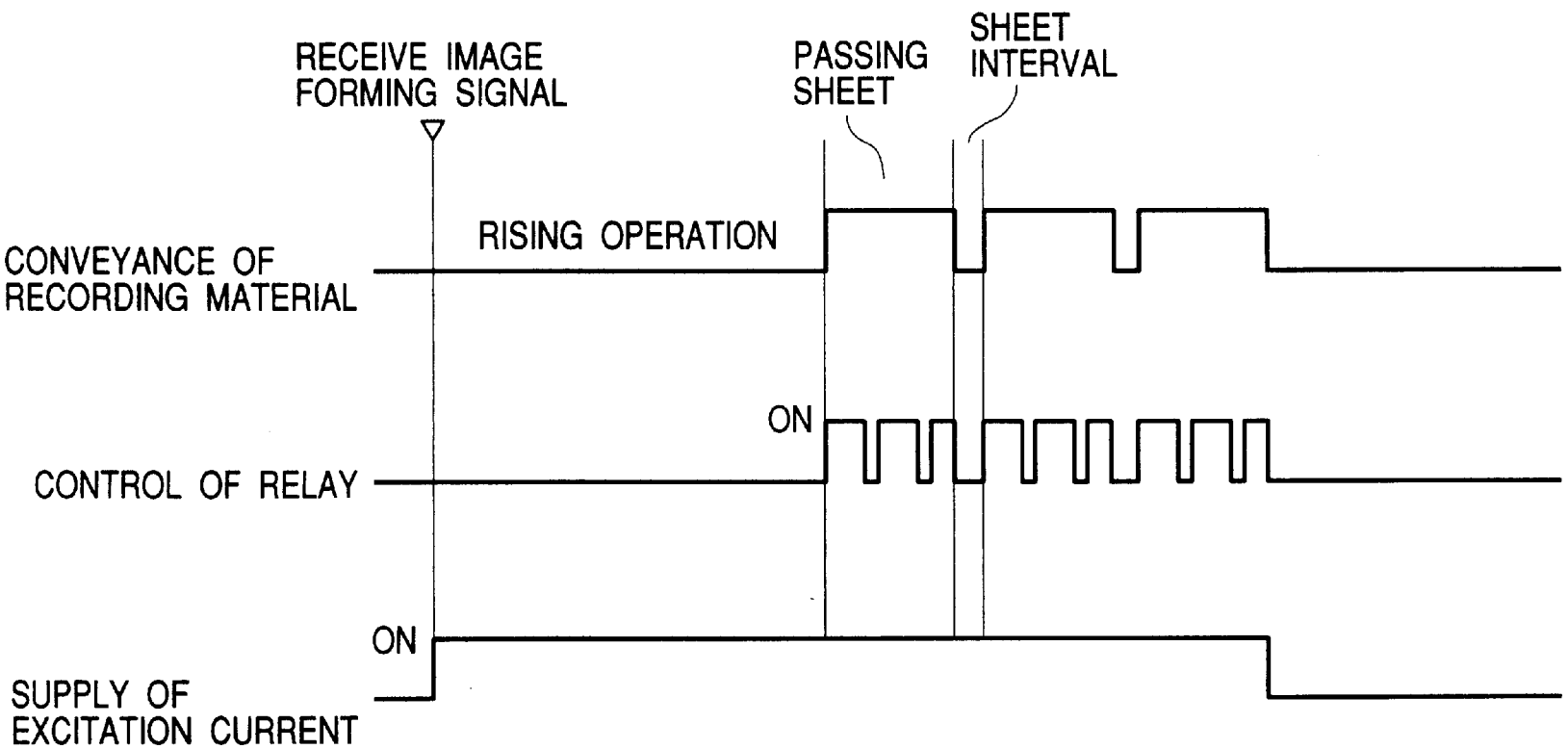
FIG. 8 is a diagram showing the control sequence of the image heating fixing apparatus.

Embodiment 2 (FIGS. 7 and 8)

FIG. 7 is a partially cutaway model view of a heat fixing apparatus provided for an image forming apparatus of the present embodiment 2. FIG. 8 is a diagram showing a control sequence of the heat fixing apparatus in the image forming apparatus.

As compared with the apparatus shown in FIGS. 1 to 5, the apparatus of the present embodiment is the same as the above one except for such a point that how to wind the excitation coil 4 in the heating assembly 1 shown in FIG. 7 and the control sequence of the heat fixing apparatus shown in FIG. 8 are different from those of the above apparatus.

That is, the excitation coil 4 is arranged so as to directly wind around the magnetic core 5. Most of the alternating magnetic fluxes generated from the excitation coil 4 pass through the magnetic core 5. Therefore, since the ring conductor 7 surrounds most of the above generated magnetic fluxes, the connection coefficient k shown in the expression 1 is approximate to 1. Most of the generated magnetic fluxes are demagnetized by closing the ring conductor 7.

As mentioned above, the excess temperature rise in the non-sheet passing area can be remarkably suppressed in the construction in which the connection coefficient regarding the ring conductor 7 and the excitation coil 4 is raised, so that such a construction is suitable for the image forming apparatus having a higher processing speed.

As shown in FIG. 8, the switching circuit 41 in the present embodiment is controlled only for a period of time during which the recording material is passed through the heat fixing apparatus 10. Owing to the control, such a phenomenon that the temperature in the non-sheet passing area of the fixing film 6 is extremely different from that in he sheet passing area of the film upon rising or for a sheet interval can be prevented.

Figure 9:
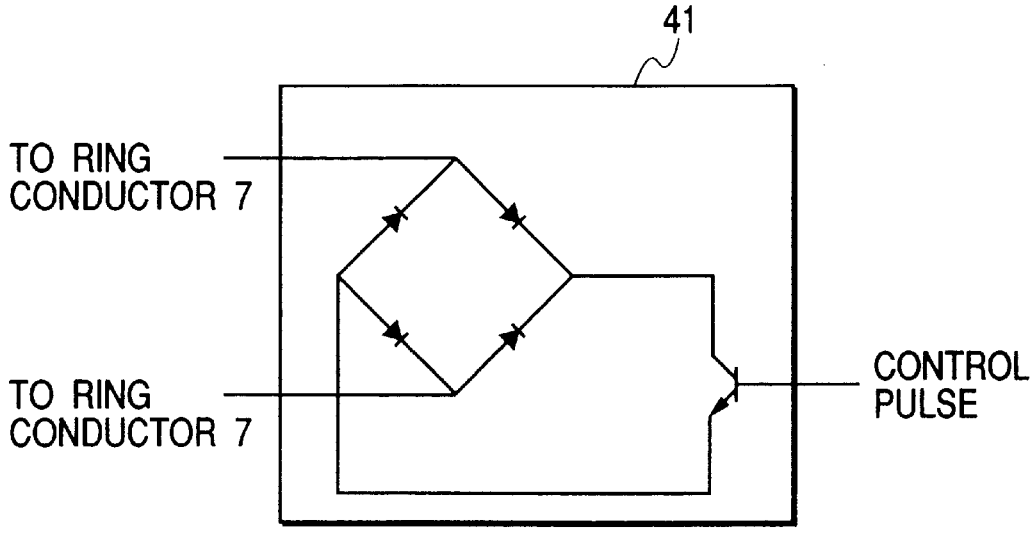
FIG. 9 is a schematic wiring diagram of an electronic switching type switching circuit.
Figure 10:
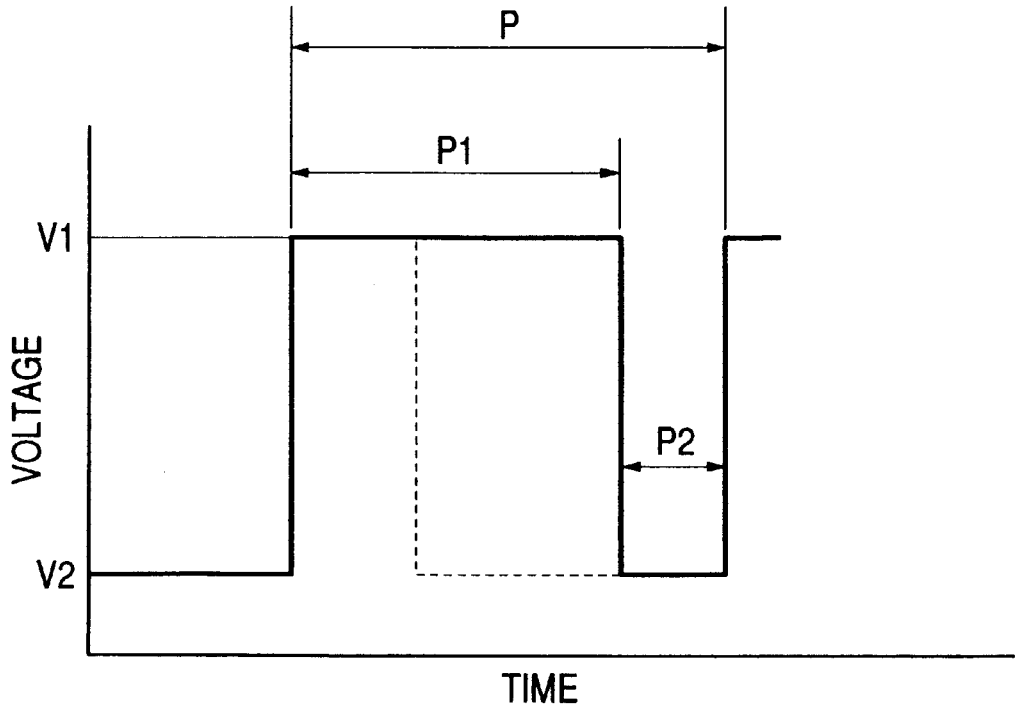
FIG. 10 is a profile of a control pulse to control the electronic switching type switching circuit.

Embodiment 3 (FIGS. 9 and 10)

FIG. 9 is a schematic diagram of the switching circuit 41 provided for an image forming apparatus of the present embodiment 3. FIG. 10 is a graph showing a control pulse to drive the switching circuit 41.

As compared with the above-mentioned apparatus in FIGS. 1 to 5, the apparatus of the present embodiment is the same as the above one except for such a point that the construction of the switching circuit 41 shown in FIG. 9 and constant in the control circuit 100 are different from those in the above apparatus.

In other words, the switching circuit 41 in the apparatus of the present embodiment is an electronic switch having no driving contact. The closing/opening operation of the ring conductor 7 can be minutely performed by the control pulse shown in FIG. 10 (one corresponding to the unit described in the embodiment 1 can be set to a short time).

In the present embodiment, as a V1 duty width P1 of a control pulse of 1 kHz (maximum pulse width P=1 ms), a value is inputted to the switching circuit 41 by using the ON ratio of the foregoing Table 1, the period of time during which the current flows through the ring conductor 7 is adjusted.

The control and the switching circuit 41 can realize heat generation in the non-sheet passing area which has no ripple and is uniform with the elapse of time. When the recording material of the middle size of B1 to B4 is passed, a heating variation in the moving direction of the recording material is not generated, so that the problems regarding the gloss variation and fixing variation can be improved.

Embodiment 4

Further, an example in which the control logic in the above-mentioned embodiment 1 is modified will now be described as an embodiment 4.

That is, in addition to the information regarding the size included in the information for the kinds of the recording materials, information regarding the sheet thickness is also stored. The ratio of the ON duty width corresponding to the above-mentioned Table 1 is determined on the basis of those stored information. Specifically, those shown in the following Table 3 are used.

TABLE 3

| Sheet | Size of recording material | | | | | |
|---|---|---|---|---|---|---|
| | A | B1 | B2 | B3 | B4 | C |
| | Width(mm) | | | | | |
| thickness (μm) | 216 | 210 | 182 | 148 | 105 | 98.4 |
| to 100 | 0 | 0 | 15 | 50 | 90 | 100 |
| 100 to 150 | 0 | 0 | 15 | 55 | 90 | 100 |
| 150 to 200 | 0 | 5 | 20 | 55 | 95 | 100 |
| 200 to | 0 | 5 | 20 | 60 | 100 | 100 |

Since the thick recording material easily absorbs heat from the fixing film 6, the control is performed at the time of temperature adjustment so that the alternating current which is allowed to flow through the excitation coil 4 is increased, so that the excess temperature rise in the non-sheet passing area tends to be accelerated. As for the ratio of the ON duty width shown in Table 3, in consideration of the above fact, the ON duty width ratio for the thick recording material is increased.

Therefore, the apparatus is widely adapted to variations of not only the size of the recording material but also the sheet thickness by the above control. The inherent throughput of the apparatus is not remarkably deteriorated and the deterioration of the fixing film 6 caused by the excess temperature rise can be prevented, so that the high durability and high processing speed of the apparatus can be realized.

Others a) The apparatus can also be constructed in such a manner that the fixing film 6 in an endless belt form is stretched around two or more members and rotatably driven by the pressurizing roller or driving means other than the pressurizing roller.

b) A roller composed of a thin magnetic material can also be used as an induction heat generating element. Also in this case, the excess temperature rise in the non-sheet passing area, which easily occurs since it is thin, can be remarkably improved by the effects of the present invention.

c) The apparatus can also be constructed in such a manner that magnetic flux generating means comprising the excitation coil 4 and the like is arranged around the induction heat generating element of the fixing film 6, and the ring conductor 7 is arranged so as to surround a part of the magnetic flux generated by the magnetic flux generating means.

Embodiment 5

Figure 12:
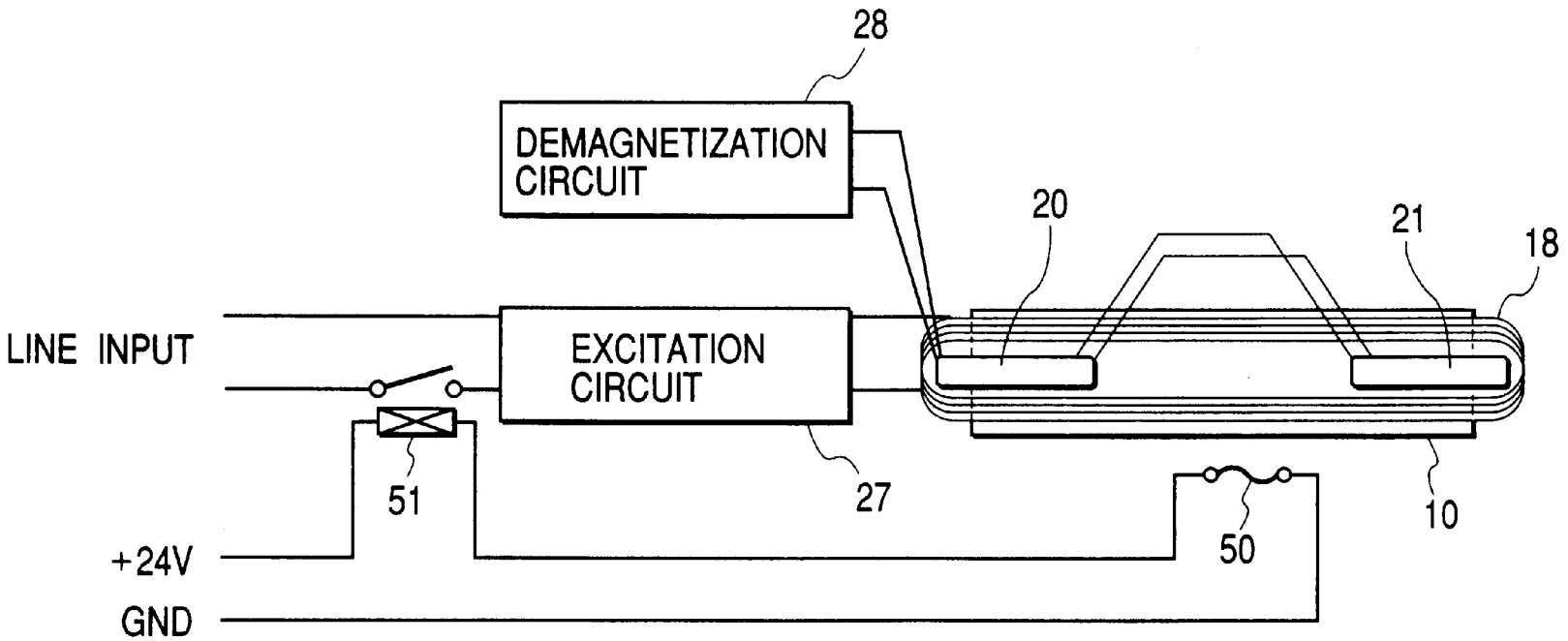
FIG. 12 is a circuit diagram showing a constructional example of a heating apparatus that is installed in an image forming apparatus according to an embodiment 5 of the present invention.

FIG. 12 is a circuit diagram showing a constructional example of a heating apparatus installed in an image forming apparatus according to the embodiment 5 of the present invention. The heating apparatus of the image forming apparatus according to the embodiment 5 of the present invention comprises: a fixing film 10 (electromagnetic heat generating member); an excitation coil 18 (magnetic field generating means); demagnetization coils 20 and 21 (coils); an excitation circuit (excitation power source circuit) 27 (high-frequency power source circuit); a demagnetization circuit 28 (supply circuit); a thermoswitch 50; and a relay 51.

The above construction will now be described. The excitation circuit 27 is connected between LINE inputs and the excitation coil 18 is connected to the excitation circuit 27. The demagnetization circuit 28 is connected to the excitation circuit 27. The demagnetization coils 20 and 21 are connected to the demagnetization circuit 28. The demagnetization coils 20 and 21 are magnetically coupled to each other. A contact of the relay 51 is inserted between the LINE inputs. The thermoswitch 50 and relay 51 are arranged between a +24V power source and a GND. When the electric power is supplied to the excitation circuit 27 through the contact of the relay 51 in response to the LINE input, the excitation circuit 27 supplies a high-frequency power to the excitation coil 18 through a voltage resonance inverter circuit (switching inverter circuit, refer to FIG. 13). The details of the voltage resonance inverter circuit will be described hereinbelow with reference to FIG. 13.

Figure 13:
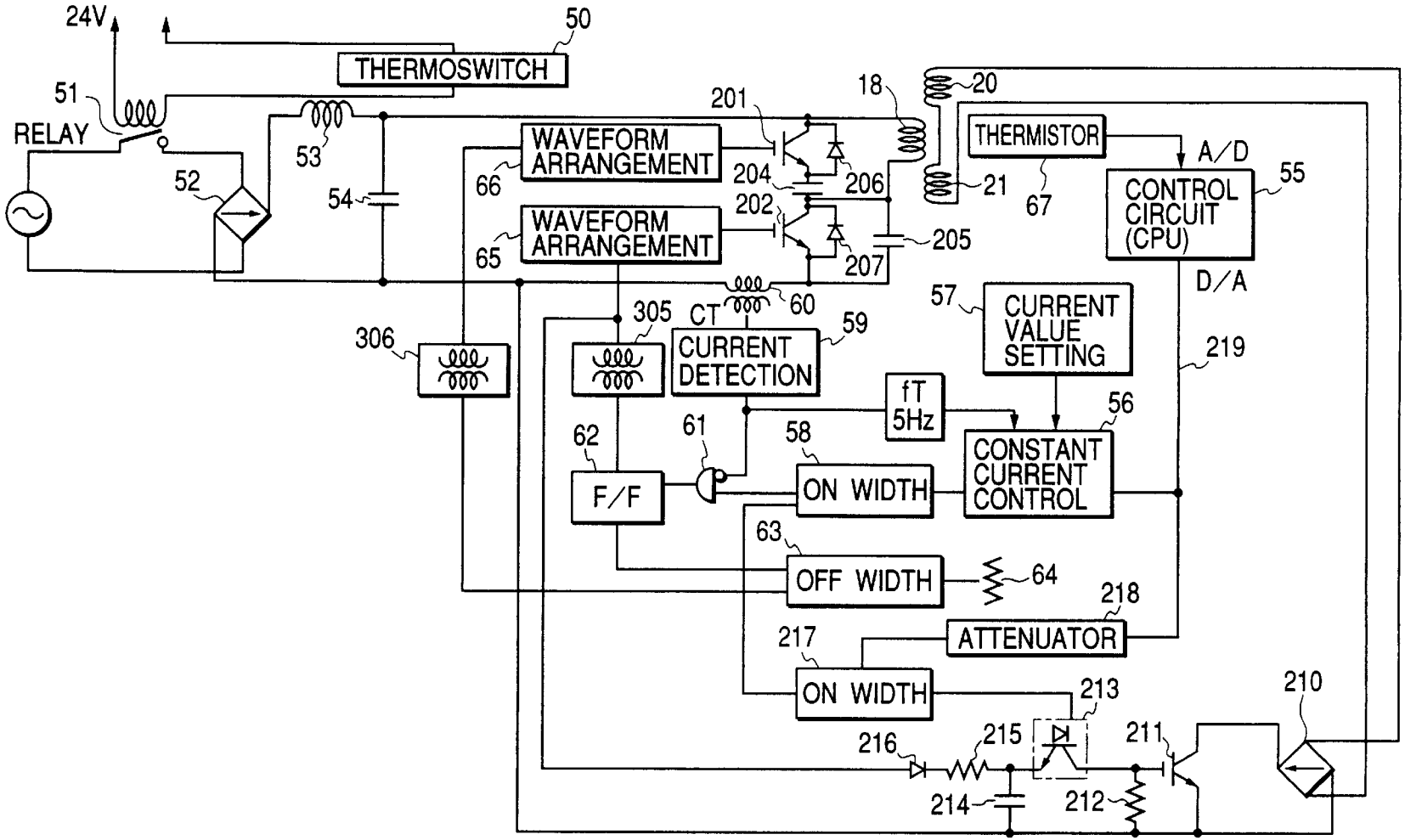
FIG. 13 is a circuit diagram showing a constructional example of a voltage resonance inverter circuit of the heating apparatus according to the embodiment 5 of the present invention.

FIG. 13 is a circuit diagram showing a constructional example of the voltage resonance inverter circuit according to the embodiment 5 of the present invention. The voltage resonance inverter circuit according to the embodiment 5 of the present invention comprises: rectifying circuits 52 and 210; a filter coil 53; capacitors 54, 205, and 214; a control circuit (CPU) 55; a constant current control circuit 56; a current value setting circuit 57; ON width control timer circuits 58 and 217; a current detection circuit 59; a current transformer (CT) 60; an OR circuit 61; a flip-flop circuit (F/F) 62; an OFF width control timer circuit 63; waveform arrangement circuits 65 and 66; a thermistor 67 (temperature detecting means); voltage resonance switching elements 201 and 202; diodes 206, 207, and 216; a switching element 211; a photocoupler 213; an attenuator 218; and gate-transformers 305 and 306. In the diagram, reference numeral 18 denotes the excitation coil and reference numerals 20 and 21 denote the magnetization coils.

The construction of the above main portion will now be described along the operation. An alternating current (AC) input power supply is received through the relay 51 and the full-wave rectification is effected by the rectifying circuit 52 to obtain a pulsed direct current (DC) power supply. After that, the current is filtered by the filter coil 53 and the capacitor 54, the gate-transformers 305 and 306 are driven so that the voltage resonance switching elements 201 and 202, each constituting a voltage resonance switching circuit, alternatively perform the switching operation, thereby applying a high-frequency AC voltage to the excitation coil 18. In other words, the current flowing through the excitation coil 18 is controlled to vary an eddy current flowing through the fixing film 10, so that a heat generation electric power is controlled.

In this instance, the power supply to the relay 51 is performed through the thermoswitch 50 for detecting the temperature of the fixing film 10 of the fixing device. If the temperature of the fixing film 10 exceeds a predetermined temperature and abnormally rises, the thermoswitch shuts off the power supply to disconnect the power supply to the excitation circuit 27, thereby protecting the fixing device from overheating and maintaining the safety. The driving operation for each of the voltage resonance switching elements 201 and 202 is performed so that double insulating for a live voltage and a secondary voltage circuit is maintained by the insulating process through the gate-transformer 305 or 306.

A fixing temperature of the fixing film 10 of the fixing device is detected by the thermistor 67. The optimum control coefficient which is varied depending on the sheet passing state in the fixing device, a paper quality, or fixing temperature is given by the control circuit (CPU) 55. A control signal 219 is outputted from the control circuit (CPU) 55. The control signal 219 from the control circuit (CPU) 55 is supplied to the voltage resonance switching element 202 through the ON width control timer circuit 58 for controlling the control ON width of the voltage resonance inverter, gate-transformer 305, and waveform arrangement circuit 65 to drive the switching element 202. In the voltage resonance inverter, excess and deficiency to a target temperature is controlled on the basis of the ON width of the voltage resonance switching element 201 or 202.

Figure 14:
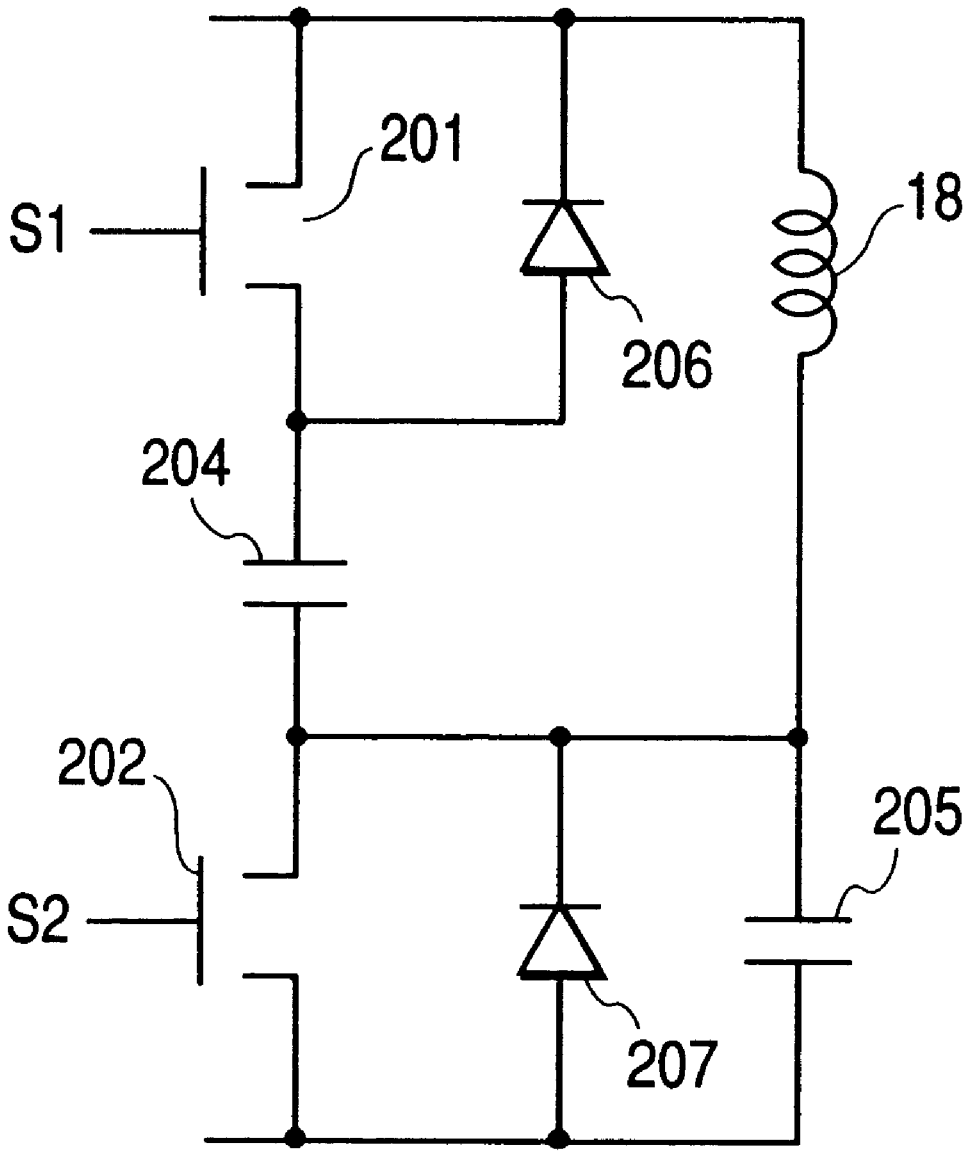
FIG. 14 is a circuit diagram for explaining the operating system to realize the voltage resonance inverter circuit of the heating apparatus according to the embodiment 5 of the present invention.

FIG. 14 is a circuit diagram for explaining the operation system for realizing the voltage resonance inverter circuit according to the above-mentioned embodiment 5 of the present invention. That is, the portion where the switching elements 201 and 202 in FIG. 13 are mainly shown is enlarged. A circuit for realizing the voltage resonance inverter circuit according to the embodiment 5 of the present invention comprises: the switching element 201; main switching element 202; excitation coil 18; a first resonance capacitor 204; second resonance capacitor 205; and regenerative diodes 206 and 207.

The above construction will now be described. The first resonance capacitor 204 is serially connected to the switching element 201 connected to the power supply. The main switching element 202 is serially connected to the first resonance capacitor 204. The excitation coil 18 for magnetic induction heating is connected between the power supply and the connection point between the first resonance capacitor 204 and the main switching element 202. The second resonance capacitor 205 is connected to the main switching element 202 in parallel. The regenerative diodes 206 and 207 are connected to the switching element 201 and the main switching element 202 in parallel, respectively.

Figure 15:
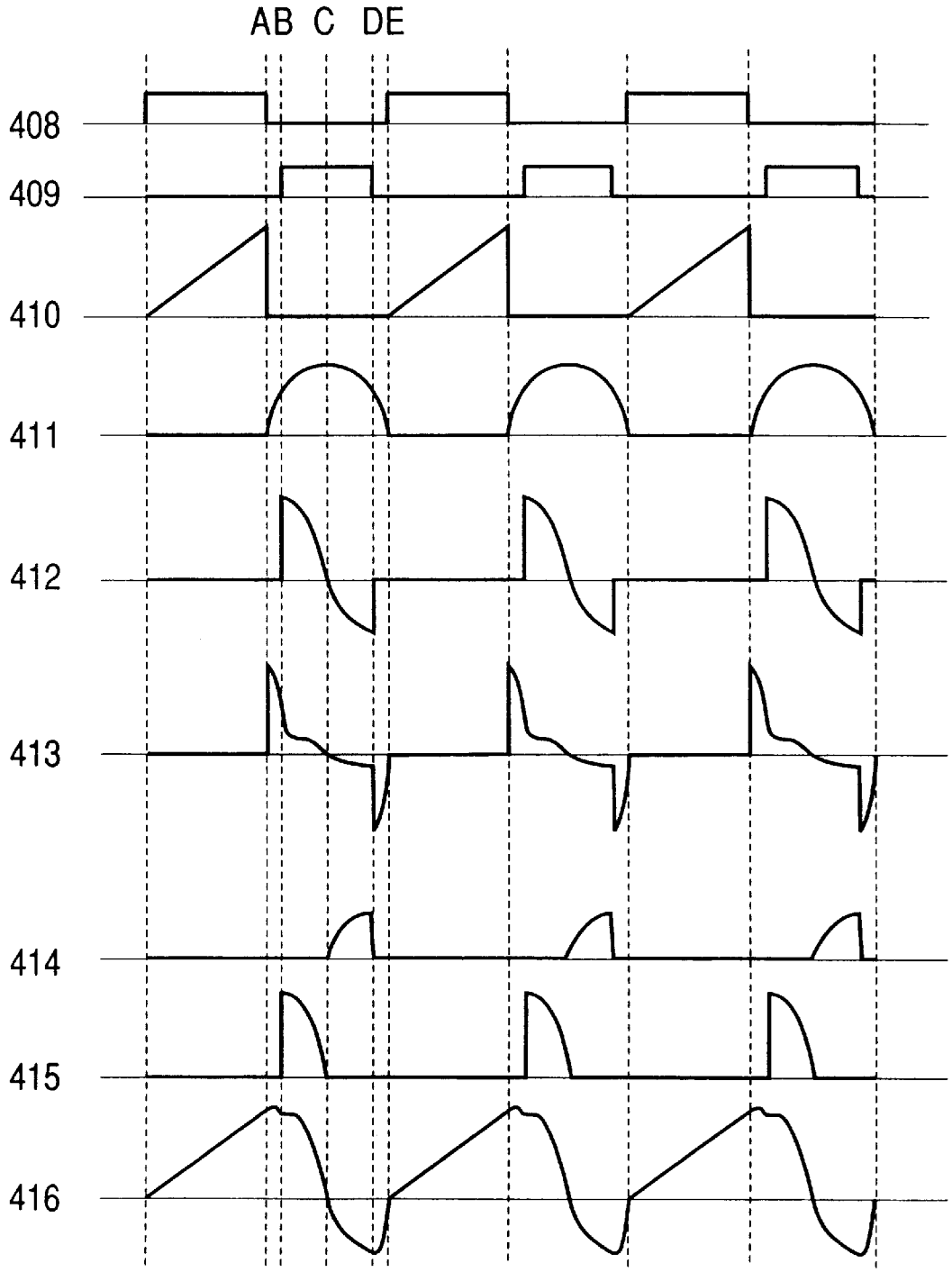
FIG. 15 is a waveform diagram showing the operating waveforms of circuits to realize the voltage resonance inverter circuit of the heating apparatus according to the embodiment 5 of the present invention.

FIG. 15 is an explanatory diagram showing operating waveforms in the circuit construction in FIG. 14 according to the embodiment 5 of the present invention. Reference numeral 408 denotes a gate voltage waveform of the switching element 201; 409 a gate voltage waveform of the main switching element 202; 410 a current waveform of the main switching element 202; 411 a current waveform of the main switching element 202; 412 a current waveform of the first resonance capacitor 204; 413 a current waveform of the second resonance capacitor 205; 414 a current waveform of the switching element 201; 415 a current waveform of the regenerative diode (rectifying element) 207; and 416 an excitation current waveform of the excitation coil 18.

The above operation will now be described. First, the induction current waveform 410 flows into the excitation coil 18 from the power supply by turning on the main switching element 202. Simultaneously with the turn-off (A point), the excitation coil 18 generates the flyback voltage 411 in the direction to maintain the current. According to the system of the present embodiment, since a difference between the residual charge of the first resonance capacitor 204 and that of the second resonance capacitor 205 occurs (due to an influence of the residual charge of the first resonance capacitor 204, which will be explained later), just after the turn-off of the main switching element 202, the voltage 211 indicates a curve determined by a resonance period $\omega=\sqrt{(L\times C)}$ that is determined by the second resonance capacitor 205 and the excitation coil 18. In this instance, it is assumed that the capacitance of the second resonance capacitor 205 is set to about 1/10 of that of the first resonance capacitor 204. Therefore, as a voltage just after the turn-off, the excitation coil 18 high-periodically generates the flyback voltage (period of A to B).

When the flyback voltage is raised up to an initial charge voltage of the first resonance capacitor 204 (B point), its oscillation turns on the regenerative diode 206, the flyback voltage is changed so as to form a gentle sine waveform due to a synthetic capacitance of the first and second resonance capacitors 204 and 205, and the resultant voltage is raised. Reference numeral 212 indicates the current waveform of the first resonance capacitor 204 at that time. Reference numeral 415 denotes the current waveform of the regenerative diode 206 at that time. Reference numeral 413 indicates the current waveform of the second resonance capacitor 205.

The voltage rises with the elapse of time. The resonance period of $\omega/4$ passes at which point the voltage reaches the maximum point (C point). On the other hand, in the case of the current waveform 212, a cosine wave corresponding to a differential waveform of the voltage waveform flows. Consequently, the current has a zero-cross waveform as a minimum value at the maximum point (C point) of the voltage. Since the regenerative diode 206 is turned off after the zero-cross point, the gate of the switching element 201 is turned on to regenerate the current (period of C to D). Reference numeral 214 denotes the current waveform of the switching element 201 at that time. The switching element 201 is turned off (D point) at which point the first resonance capacitor 204 is disconnected and the second resonance capacitor 205 of a small capacitance is resonated to indicate a highly periodic curve (period of D to E). Such action is the most remarkable operation of the present invention. The period of D to E will now be described in more detail.

All of a discharging current flowing through the first resonance capacitor 204 is supplied to the second resonance capacitor 205 at D point. When such a state is verified as a change in damping $[=\sqrt{(L/C)}]$ as a value contributed to the oscillation of the circuit, decreasing a value of C results in an increase in damping factor in proportion to the decreasing amount of C, so that strong oscillation of a short period is obtained as an effect. The strong oscillation voltage is the most important factor of the voltage resonance to generate the zero-cross point of the flyback voltage waveform due to the voltage oscillation, namely, E point of the voltage waveform 411.

At E point, both of the current and the voltage are low. When the switching element is turned on, switching loss can be suppressed to a minimum value. As for the switching element 201 for switching the regenerative current, the voltage is relatively low as it is approximate to the power supply voltage and it performs the switching operation at D point when the current value is low because it is damped due to the excitation supply. Consequently, the switching element 201 and the main switching element 202 can perform such a switching operation that the switching loss is remarkably low. According to the present construction, even at the time of activating the inverter, the switching element 201 connected to the first resonance capacitor 204 can be activated from the OFF state, so that a transient burden that is generated at the time of activating the resonance power supply can be extremely reduced.

Figure 16:
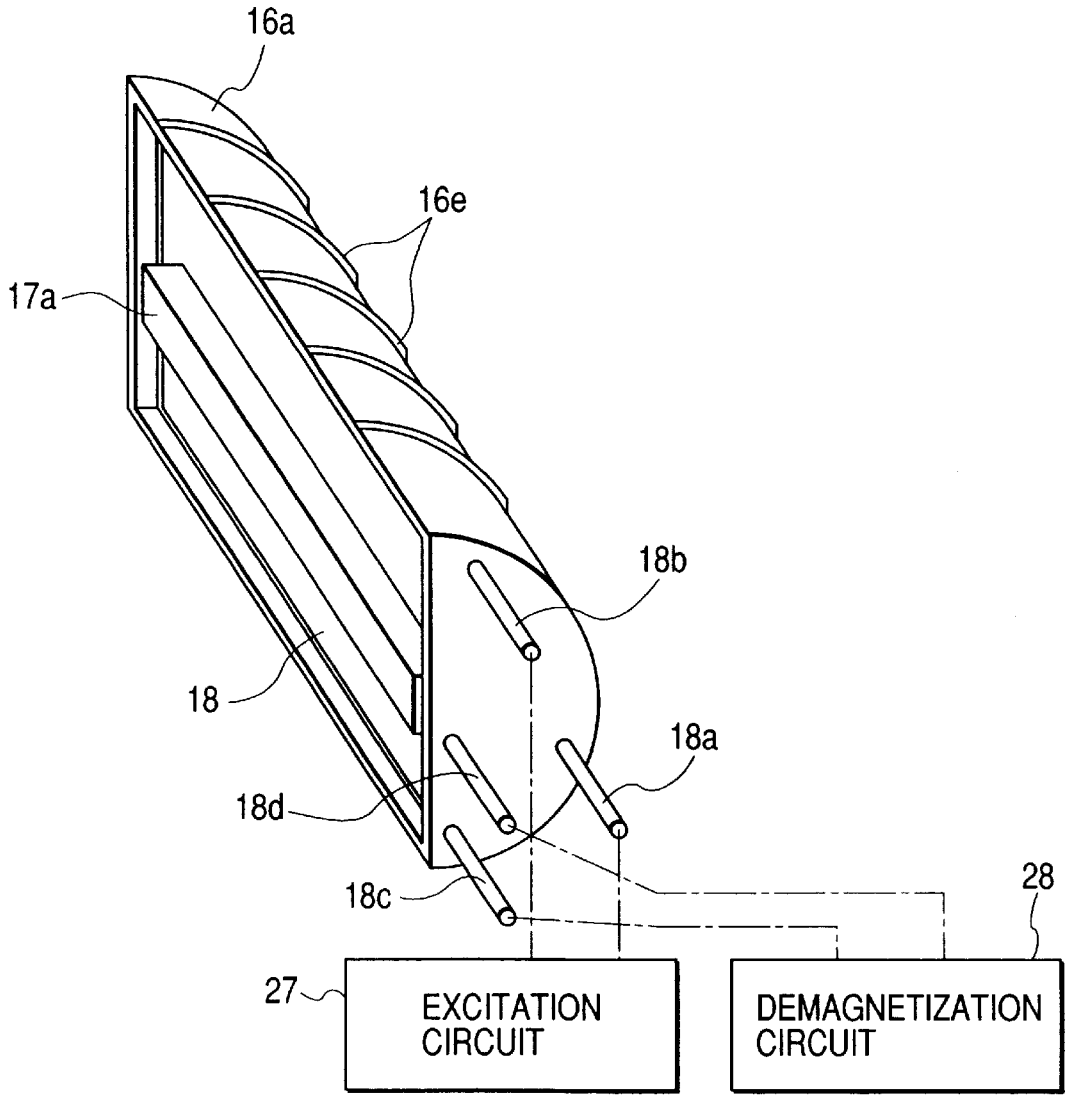
FIG. 16 is a perspective view showing the constructions of a film guide member and an excitation coil of the heating apparatus according to the embodiment 5 of the present invention.

FIG. 16 is a perspective view showing constructions of a film guide member, the excitation coil, and the like of the heating apparatus according to the embodiment 5 of the present invention. Referring to FIG. 16, reference numeral 16*a* denotes a film guide member; 16*e* embossed rib portions formed at regular intervals longitudinally along the peripheral surface of the film guide member 16*a*; 17*a* a ferrite core; 18 excitation coil; and 18*a* to 18*d* power supply portions. The excitation circuit 27 is connected to the excitation coil 18 through the power supply portions 18*a* and 18*b*. The demagnetization circuit 28 is connected to the demagnetization coil (not shown in FIG. 16) through the power supply portions 18*c* and 18*d*.

The high-frequency switching voltage formed as described in detail in FIG. 15 is applied to the excitation circuit 27 comprising the ferrite core 17*a* and the excitation coil 18 in FIG. 16 to supply high-frequency magnetism to the fixing film 10 which is in contact with the external surface of the film guide member. The fixing film 10, being contact with the external surface of the member, allows to generate heat corresponding to the strength of the magnetism by the eddy current due to the high-frequency magnetism.

Figure 17:
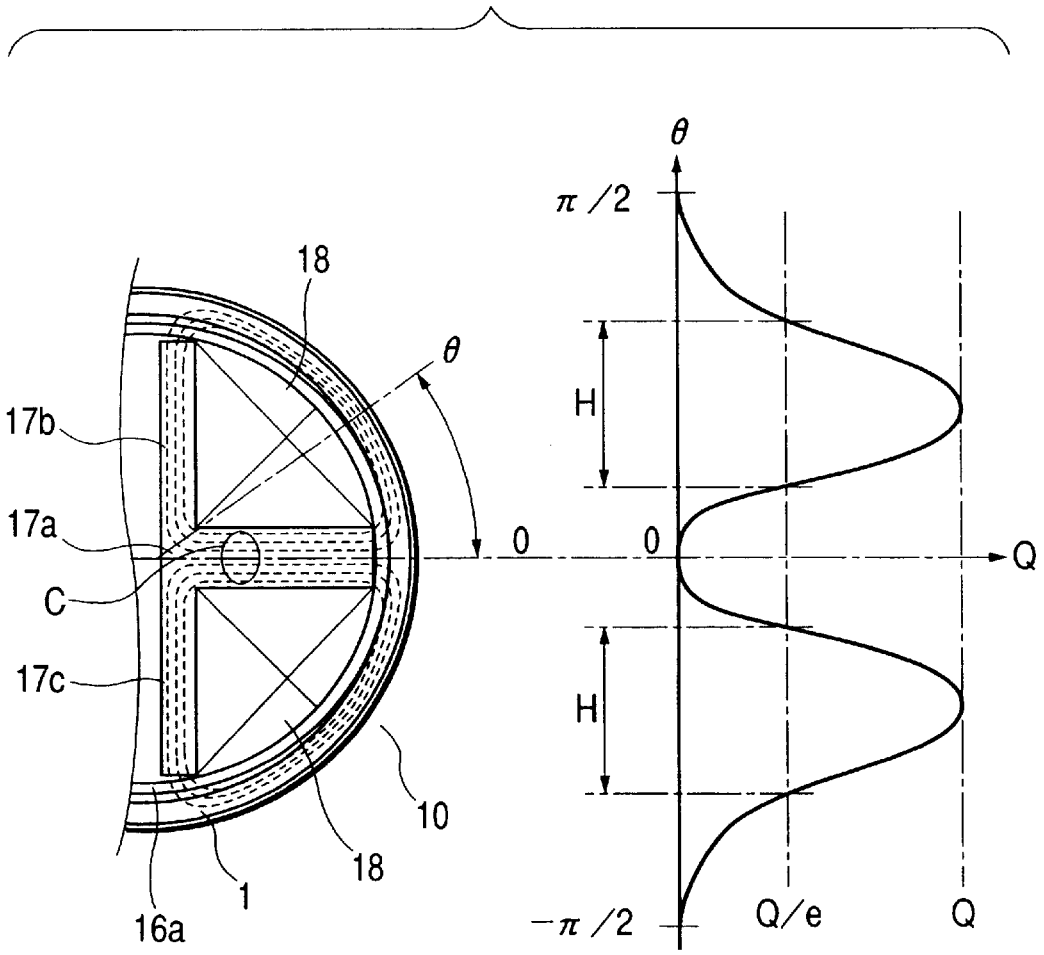
FIG. 17 is an explanatory diagram showing the generating state of an alternating magnetic flux in a fixing film of the heating apparatus according to the embodiment 5 of the present invention.

FIG. 17 is an explanatory diagram showing the state of the occurrence of the alternating magnetic flux in the fixing film of the heating apparatus according to the embodiment 5 of the present invention. That is, it shows the above state of the magnetism. Referring to FIG. 17, reference numeral 18 denotes the excitation coil and reference numerals 17*a* to 17*c* indicate the ferrite cores arranged so that the magnetic flux produced by the excitation coil 18 is efficiently coupled to the fixing film 10 which is in contact with the outside. The maximum magnetic flux density is obtained in a portion defined by an argument shown by reference symbol θ in the diagram, where the highest current density is shown in the case that the minimum density is shown in a portion corresponding to the central portion of the excitation coil 18. In the case of the coil as a coil frame wound as shown in FIG. 17, θ is equal to about 45 degree (45/180 π rad).

Figure 18:
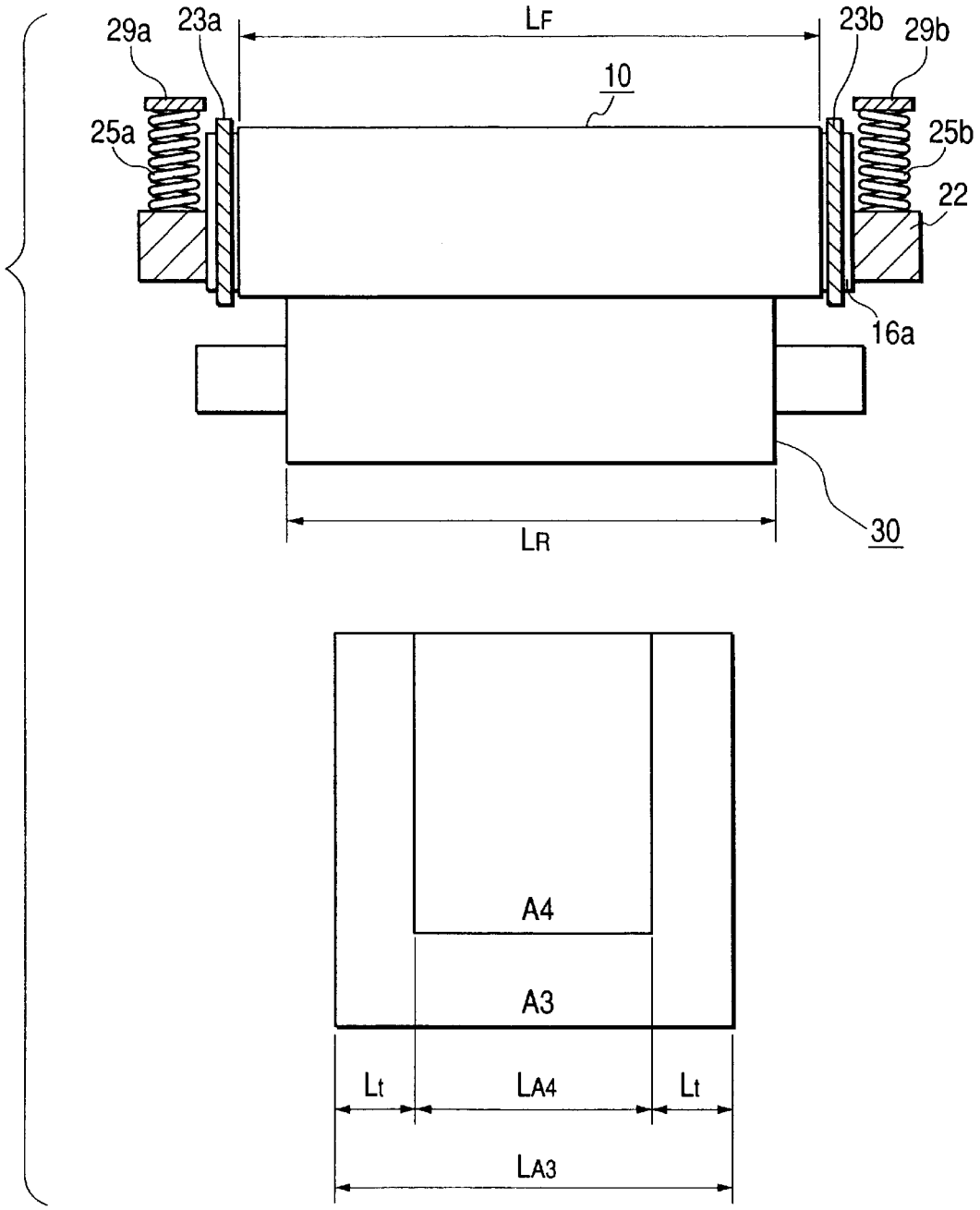
FIG. 18 is a constructional diagram showing the construction of the main portion of the heating apparatus according to the embodiment 5 of the present invention.

FIG. 18 is a constructional diagram showing the construction of the main portion of the heating apparatus according to the embodiment 5 of the present invention. A pressurizing roller 30 comprises a core and a heat-resistant elastic layer laminated around the core. A pressurizing spring 25*a* is arranged so as to be compressed between one end of a rigid stay 22 for pressurizing and a spring bearing member 29*a* and a pressurizing spring 25*b* is similarly arranged so as to be compressed between the other end of the stay 22 and a spring bearing member 29*b*, respectively. Each spring operates a depressing force to the rigid stay 22 for pressurizing. Consequently, the bottom surface of the film guide member 16*a* is come into press-contact with the upper surface of the pressurizing roller 30 through the fixing film 10 to form the nip portion having a predetermined width.

Figure 19:
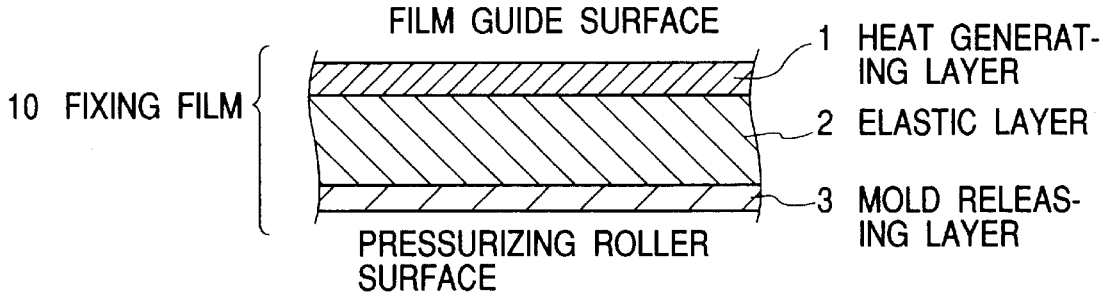
FIG. 19 is an explanatory diagram showing the layer construction of the fixing film of the heating apparatus according to the embodiment 5 of the present invention.

FIG. 19 is an explanatory diagram showing the layer construction of the fixing film 10 of the heating apparatus according to the embodiment 5 of the present invention. The fixing film 10 of the heating apparatus according to the embodiment 5 of the present invention has a composite structure comprising the heat generating layer 1 composed of a metallic film, serving as a base layer of the fixing film 10 having the electromagnetic induction heat generating properties; the elastic layer 2 laminated on the external surface of the layer 1; and the mold releasing layer laminated on the layer 2. The alternating magnetic flux operates on the heat generating layer 1 to generate the eddy current in the heat generating layer 1, so that the heat generating layer 1 generates heat. The fixing film 10 is heated by the heat through the elastic layer 2 and the mold releasing layer (parting layer) 3. The heating material (recording material) which is passed through the fixing nip portion is heated to thermally fix the toner image.

Figure 20:
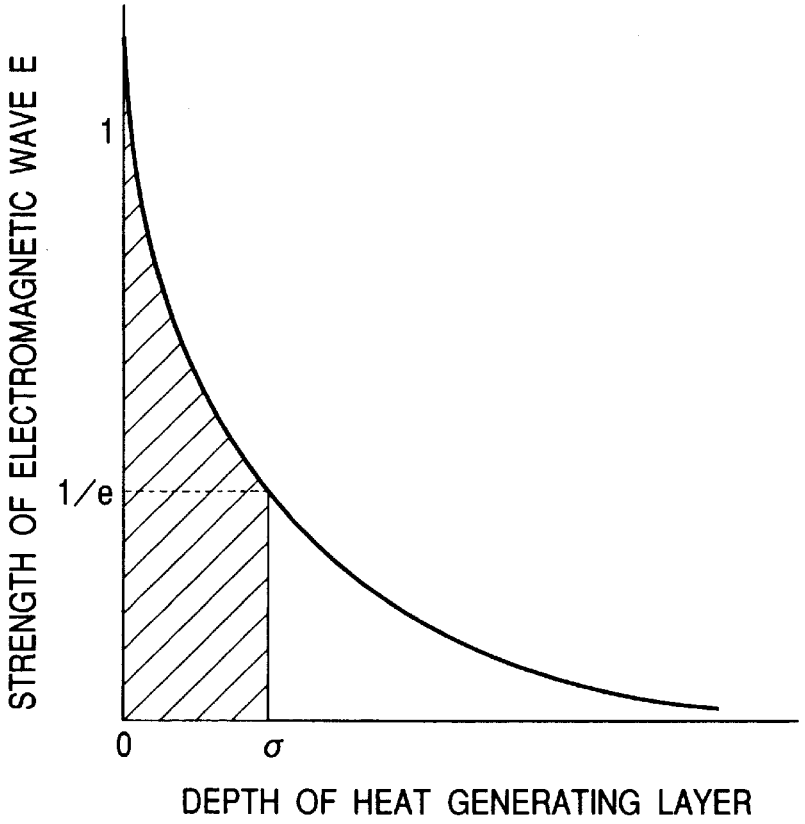
FIG. 20 is a graph for explaining a relation between the strength of an electromagnetic wave and the depth of a heat generating layer according to the embodiment 5 of the present invention.

FIG. 20 is an explanatory diagram showing a relation between the strength of the electromagnetic wave and the depth of the heat generating layer 1 of the fixing film 10 according to the embodiment 5 of the present invention.

Referring to FIG. 18, the width of a sheet passing through the heating apparatus is narrower than both of the width $L_F$ of the fixing film 10 and the width $L_R$ of the pressurizing roller 30. In such a heating apparatus, when a sheet of the A4 size is passed, as compared with the case of passing a sheet of the A3 size, the sheet passing is not performed on areas shown by Lt and the outside of the sheet in the diagram, so that a portion without heat supply is formed. In the normal temperature control to detect a temperature on the center portion, consequently, a temperature abnormally rises in the portions corresponding to the end portions Lt. As for the fixing film 10 realizing the induction heat fixing especially proposed in the present invention, the heat-resistant rubber layer referred to as an elastic layer 2 and the mold releasing layer 3 to assure the fixing properties for the toner are laminated on the heat generating layer 1 composed of a metallic film as shown in FIG. 19.

In other words, since the fixing film 10 as a heat generating element is composed of film-shaped metal of low specific heat, when a heat generation electric power is supplied to the fixing film 10, the heat of the fixing film 10 immediately passes through the elastic layer 2 as a heat-resistant rubber layer and is transferred to the unfixed toner surface via the mold releasing layer 3. Consequently, the toner can be efficiently fixed and, simultaneously, a rapid heating response can be given. However, in the end portions in the lateral direction of the film-shaped thin metal, where the heat conduction is low and the heat supply is low, in the case of the heating apparatus which does not cope with the temperature rise in the film end portions, the temperature difference between the central portion and the end portions of the film reaches to 40 degrees remarkably in the continuous sheet passing state. As harmful effects caused by the large temperature difference, a blister phenomenon (such a phenomenon that an excessive temperature is exerted on the toner and the toner is fixed in a bubble state) occurs in the film end portions to cause the deterioration of the image quality. The occurrence of sharp temperature gradient of the heat supply to the media causes sheet wrinkle or jam in the worst case.

In the heating apparatus according to the embodiment 5 of the present invention, the demagnetization coils 20 and 21 which have been described in FIG. 12 are arranged in the portions corresponding to the end portions Lt shown in FIG. 18 to control the strength of the magnetic flux as necessary.

Figure 21:
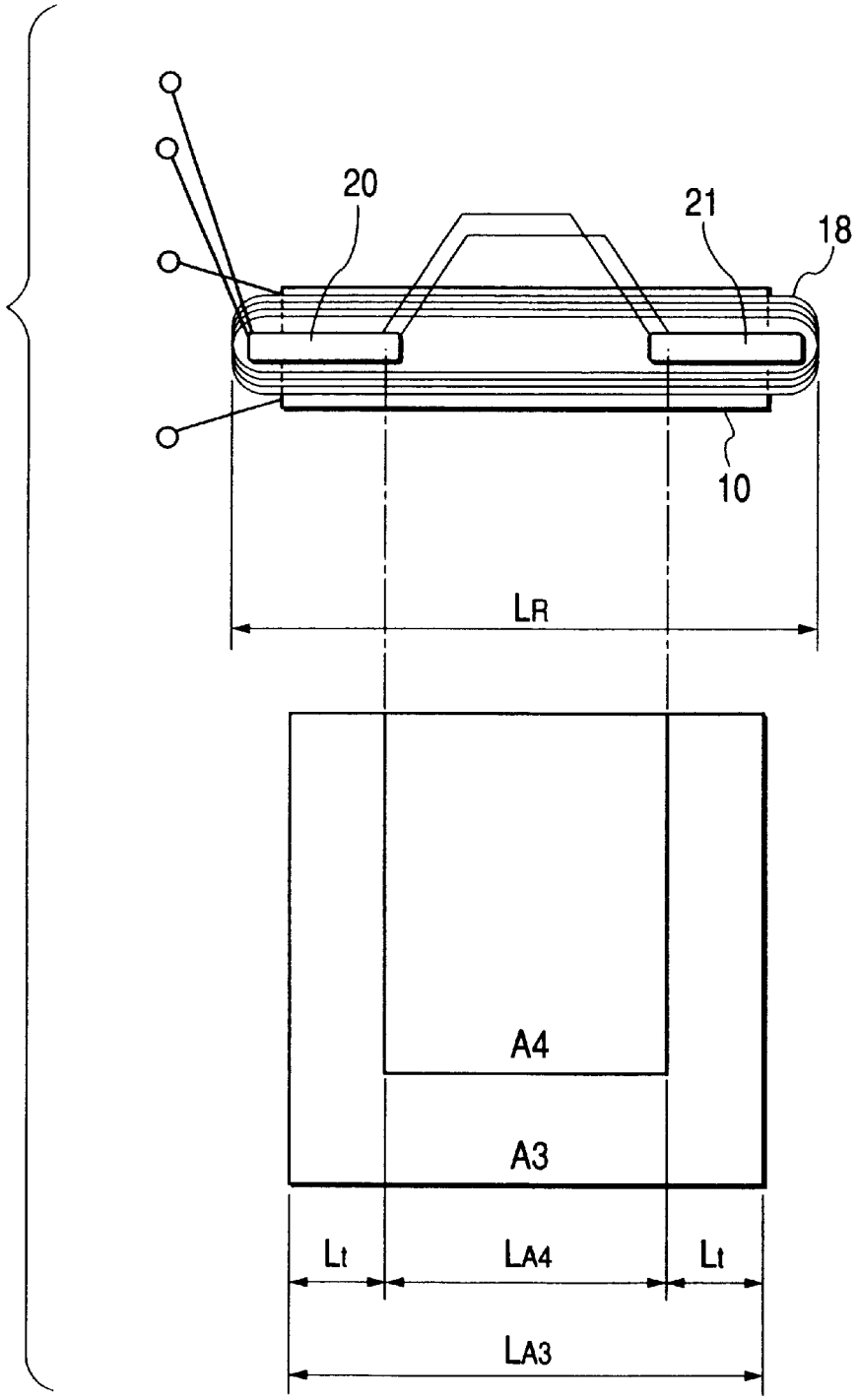
FIG. 21 is a constructional diagram showing the constructions of an excitation coil, demagnetization coils, the fixing film of the heating apparatus according to the embodiment 5 of the present invention.

FIG. 21 is a constructional diagram showing the constructions of the excitation coil, demagnetization coils, and fixing film according to the embodiment 5 of the present invention. The demagnetization coils 20 and 21 are disposed in the portions where it is desirable to reduce the magnetism for the excitation coil 18, namely, which correspond to the end portions Lt. In this case, since the demagnetization coils 20 and 21 which are magnetically coupled to each other directly magnetically short-circuit the excitation coil 18, the same effect as that obtained by winding the coil 18 so as to be narrowed as much as the portions Lt is derived.

Schematically speaking, an electromotive force induced by the short-circuit coils 20 and 21, which are electrically coupled to each other, has a polarity opposite to that of the coils applied to the excitation coil 18 and indicates a value as much as the magnetic flux. In other words, short-circuiting the electromotive force of the demagnetization coils 20 and 21 demagnetizes the magnetic flux penetrating the demagnetization coils 20 and 21 to 0. Accordingly, it is possible to realize the operation such that the heating operation is not performed to the portions of the fixing film 10 corresponding to the demagnetization coils 20 and 21. Consequently, the width to which the magnetic flux reaches can be set to a predetermined width, for example, the A4 width. It is possible to avoid heating the end portions Lt as shown in FIG. 18.

The circuit portion to control the above-mentioned demagnetization coils 20 and 21 will now be described while again referring to FIG. 13. The rectifying circuit (full-wave rectifying bridge) 210 is connected to the outputs of the demagnetization coils 20 and 21. Reference numeral 211 denotes the semiconductor switching element; 212 a gate resistor of the switching element 211; and 213 the photocoupler. A circuit comprising the capacitor 214, a resistor 215, and the diode 216 is a DC rectifying circuit connected to the gate-transformers 305 and 306 for driving the switching elements 201 and 202 of the excitation circuit 27. Reference numeral 217 denotes the ON width control timer circuit for generating timing of the ON width for the demagnetization circuit 28; 218 the attenuator; 219 the excitation electric power control instruction signal to control by a PID (Proportional plus Integral plus Derivative) process in accordance with the temperature measurement result.

The above construction and operation will now be described in detail. An AC induction voltage generated in the demagnetization coils 20 and 21 is full-wave rectified by the rectifying circuit (full-wave rectifying bridge) 210. The semiconductor switching element 211 short-circuits the full-wave rectified output so that both the ends of the demagnetization coils 20 and 21 can be bidirectionally short-circuited. In this case, since the semiconductor switching element 211 is connected to the demagnetization coils 20 and 21, it constructs a primary circuit of an AC line input similar to the semiconductor switching elements 201 and 202.

Therefore, there is a specified insulating process is requested from a secondary circuit of a control circuit system (printer sequence controller) of the image forming apparatus. As a method, a DC voltage is formed from the coil of the gate-transformer (switching gate driving pulse transformer) 305 of the excitation coil 18 through the diode 216, resistor 215, capacitor 214, and rectifying circuit 210 and the photocoupler 213 is turned on/off by the DC voltage to control the semiconductor switching element 211.

The circuit to control the electric power in the end portions of the fixing film 10 is constructed so as to control the electric power in the film end portions on the basis of a value obtained by attenuating the value of the excitation electric power control instruction signal 219 as mentioned above. Reducing the electric power according to the electric power instruction value for the film end portions, namely, executing the short-circuit process in accordance with a value of the electric power instruction input for the film end portions accomplishes the object. Since the circuit with the present construction to control the electric power in the end portions of the fixing film 10 can control the magnetic flux in the film end portions, which is proportional to the electric power to be supplied to the excitation coil 18, the circuit can operate without being influenced by the state (upon activation or ambient temperature) of the heating apparatus. Consequently, the control can be simply and easily performed. The heating apparatus with high temperature uniformity can be realized.

As mentioned above, according to the embodiment 5 of the present invention, in the heating apparatus for heating a material to be heated by the electromagnetic induction heat generating system, the apparatus comprises the excitation coil 18 as magnetic field generating means; fixing film 10 as electromagnetic induction heat generating means for electromagnetically inductively generating heat when the film passes through the area where the magnetic field generated from the excitation coil 18 exists; pressurizing roller 30 as pressurizing means which is pressed against the fixing film 10 to sandwich the heating material therebetween; excitation circuit 27 as a high-frequency power source circuit to supply a high-frequency current to the excitation coil 18; demagnetization coils 20 and 21 as coils coupled to the magnetic flux generated from the excitation coil 18; and demagnetization circuit 28 as a supply circuit to supplying a current due to the electromotive force coupled to the demagnetization coils 20 and 21. Consequently, the heating apparatus has the following operation and effects.

According to the above construction, in the magnetic induction heat generating apparatus with the construction for heating the fixing film 10 as a heating element by the magnetic field generated from the excitation coil 18, the demagnetization coils 20 and 21 as a second magnetic flux coupling coil, which are different from the excitation coil 18 as a magnetic path generating coil provided in the magnetic path of the apparatus, generate the electromotive force to allow the current to flow through the demagnetization circuit 28 as a supply circuit to supply a current, so that a counter-electromotive force is operated on the magnetic flux generated from the excitation coil 18 so as to demagnetize the magnetic flux. In this manner, the magnetic flux is controlled. Therefore, the demagnetization coils 20 and 21 to demagnetize the magnetic flux are arranged in the portions as differences in width between the recording media of different sizes. Only the portions (end portions) which are unnecessary to be heated are demagnetized to suppress the temperature rise in the end portions where the sheet is not passed.

The switching element 211 is connected to the demagnetization coils 20 and 21 operating as such a supply circuit. Therefore, even if the demagnetization effect of the demagnetization coils 20 and 21 is optimized, the demagnetization circuit 28 as a supply circuit is short-circuited. At the time of rising the heating apparatus, however, the mold member in contact with the fixing film 10 and the excitation coil 18 arranged in the member are cooled. When the temperature control is initially performed in the short-circuit state, the electric power gradient between the central portion and the end portion is too large, so that the fixing properties of the end portion are lacked. Therefore, in order to realize the construction which can be controlled in accordance with the sheet passing state or value of the temperature in the end portions, the short-circuit state is controlled by the switching semiconductor or relay.

The thermistor 67 as temperature detecting means is provided near at least one of the demagnetization coils 20 and 21 as coils coupled to the magnetic flux generated from the excitation coil 18 as magnetic field generating means to control the switching period of time of the switching element 211 in response to a value from the thermistor 67. Therefore, controlling the switching state, particularly, the switching ON width on the basis of the temperature measurement result for the end portion enables the temperature control in the end portion to be controlled separately from the control of the electric power of the excitation coil 18, so that the temperature precision in the end portion can be raised.

In other words, according to the embodiment 5 of the present invention, in the on-demand fixing operation such that the fixing film made of metal is heated by the magnetic induction heat fixing system, the temperature rise in the end portions of the fixing device is suppressed and the uniform fixing temperature is supplied to toner images on the sheet, so that there is such an effect that a printing output with stable gloss and a high image quality can be obtained. The resonance system power source is used and the control operations for the excitation coil and the demagnetization coils are synchronously performed in the area for the switching cycle, so that there is such an effect that the switching loss and switching noises can be suppressed to low levels in spite of using the large power.

Embodiment 6

Figure 22:
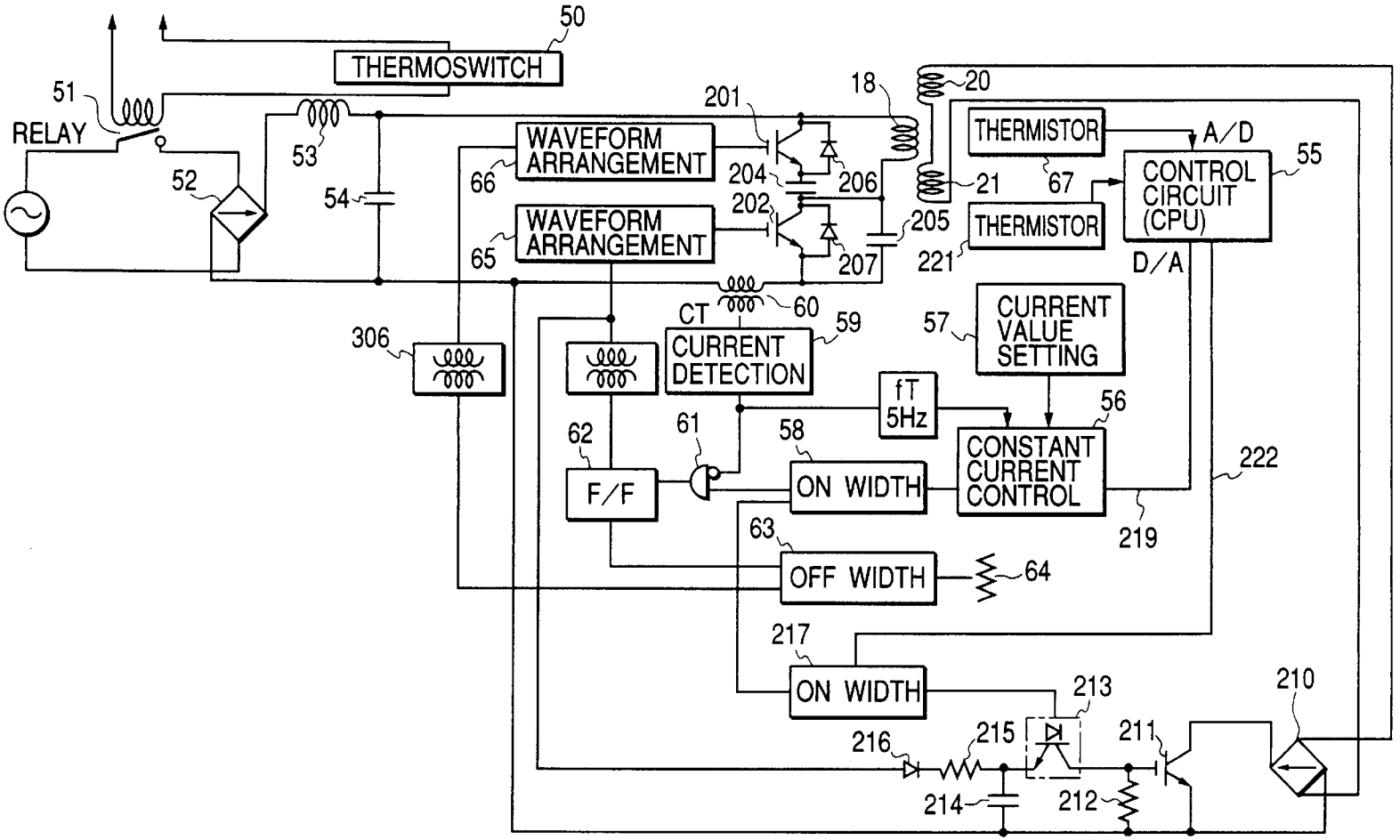
FIG. 22 is a circuit diagram showing a constructional example of a voltage resonance inverter circuit of a heating apparatus according to an embodiment 6 of the present invention.

FIG. 22 is a circuit diagram showing a constructional example of a voltage resonance inverter circuit according to the present embodiment 6 of the present invention. The voltage resonance inverter circuit according to the embodiment 6 of the present invention comprises: the rectifying circuits 52 and 210; filter coil 53; capacitors 54, 205, and 214; control circuit (CPU) 55; constant current control circuit 56; current value setting circuit 57; ON width control timer circuits 58 and 217; current detection circuit 59; current transformer (CT) 60; OR circuit 61; flip-flop circuit (F/F) 62; OFF width control timer circuit 63; waveform arrangement circuits 65 and 66; thermistors 67 and 221; voltage resonance switching elements 201 and 202; diodes 206, 207, and 216; switching element 211; photocoupler 213; and gate-transformers 305 and 306. Referring to FIG. 22, reference numeral 18 denotes the excitation coil; and 20 and 21 demagnetization coils. In FIG. 22, the same constitutional components as those in FIG. 13 are designated by the same reference numerals and the description is omitted or simplified.

The construction of the main portion will now be described along the operation. In the embodiment 6, a thermistor 221 is newly added in addition to the thermistor 67 in the embodiment 5. The thermistor 221 is arranged on the position where the demagnetization coil 20 or 21 is disposed, namely, on the end portion and is attached to at least one of the demagnetization coils 20 and 21. Since the temperature in the end portion is directly measured, for example, media information of a heating material to be passed or passing sheet interval information is not needed. The ON width control timer circuit 217 is directly controlled on the basis of temperature information regarding the end portion, so that the temperature control of the end portion at high precision can be realized.

As mentioned above, according to the embodiment 6 of the present invention, similar to the embodiment 5, in the on-demand fixing operation such that the fixing film made of metal is heated by the magnetic induction heat fixing system, the temperature rise in the end portions of the fixing device is suppressed and the uniform fixing temperature is supplied to toner images on the sheet, so that there is such an effect that a printing output with stable gloss and a high image quality can be obtained. The resonance system power source is used and the control operations for the excitation coil and the demagnetization coils are synchronously performed in the area of the switching cycle, so that there is such an effect that the switching loss and switching noises can be suppressed to low levels in spite of using the large power.

Other Embodiment

Although the kind of the image forming apparatus in which the heating apparatus of the present invention was installed has not been especially mentioned in the above-mentioned embodiments 5 and 6 of the present invention, the present invention can be applied to various image forming apparatuses such as copying machine and printer for thermally fixing an unfixed image as a permanent fixed image to a heating material to form the image.

Although an apparatus or a system to which the heating apparatus of the present invention was applied has not been especially mentioned in the foregoing embodiments 5 and 6 of the present invention, the present invention can be applied to an image forming system comprising a plurality of devices such as an image forming apparatus and can also be applied to an apparatus comprising one device such as an image forming apparatus.

The present invention is not limited to the foregoing embodiments but many modifications and variations are possible within the spirit and scope of the appended claims of the invention.

What is claimed is:

1. An image heating apparatus comprising:

magnetic flux generating means;

a heat generating body for electromagnetically inductively generating heat due to an operation of a magnetic flux generated by said magnetic flux generating means;

a conductor provided so as to surround a part of the magnetic flux generated by said magnetic flux generating means;

switching means which is connected to said conductor and which can form an electrically closed circuit by using said conductor; and control means for controlling an ON/OFF ratio of said switching means in accordance with a kind of a recording material.

2. An image heating apparatus according to claim 1, wherein said heat generating body is provided along a width of a recording material of a typical maximum size which can be used at least for said apparatus and said conductor is arranged to a position corresponding to a non-sheet passing area of a recording material of a typical minimum regular size which can be used for the apparatus.

3. An image heating apparatus according to claim 2, wherein said control means controls the ON/OFF ratio of said switching means in accordance with a size of the recording material.

4. An image heating apparatus according to claim 3, wherein said control means increases the ON ratio of said switching means as the size of the recording material is small.

5. An image heating apparatus according to claim 2, wherein said control means controls the ON/OFF ratio of said switching means in accordance with a thickness of the recording material.

6. An image heating apparatus according to claim 5, wherein said control means increases an ON ratio of said switching means as the thickness of the recording material is great.

7. An image heating apparatus according to claim 1, wherein the closed circuit using said conductor does not electrically have a power source.

8. An image heating apparatus according to claim 1, wherein said magnetic flux generating means has an excitation coil on a position opposite to said heat generating body.

9. An image heating apparatus according to claim 8, further comprising a magnetic core in said excitation coil and said conductor is provided on one part of said magnetic core.

10. An image heating apparatus according to claim 1, wherein said heat generating body is a rotary body which is come into contact with the recording material.

11. An image heating apparatus according to claim 10, wherein said rotary body is a film.

12. An image heating apparatus according to claim 1, further comprising a rotary body which comes into contact with the recording material, wherein said heat generating body is provided in said rotary body.

13. An image heating apparatus comprising:

a heat generating member;

a first coil generating magnetic flux, wherein an eddy current is generated on said heat generating member by the magnetic flux generated by said first coil, said heat generating member generates heat by the eddy current, and an image on a recording material is heated by the heat;

a second coil and a third coil for canceling the magnetic flux generated by said first coil without connecting a power source, wherein said second coil and said third coil are constituted by an electrically conductive line connected; and switching means connected to said electrically conductive line to make the electrically conductive line an open circuit or a closed circuit.

14. An image heating apparatus according to claim 13, wherein said first coil extends long in a direction orthogonal to a moving direction of the recording material, and said second coil and third coil are provided at both end portions of said first coil in a longitudinal direction thereof respectively.

15. An image heating apparatus according to claim 13, further comprising a back up member forming a nip portion with said heat generating member, wherein the recording material bearing an unfixed image at the nip portion is pinched and conveyed, and the unfixed image is fixed on the recording material by the heat of said heat generating member.

16. An image heating apparatus comprising:

a heat generating member;

a first coil for generating magnetic flux, wherein an eddy current is generated on said heat generating member by the magnetic flux generated by said first coil, said heat generating member generates heat by the eddy current, and an image on a recording material is heated by the heat; and a second coil for cancelling the magnetic flux generated by said first coil, wherein a space enclosed by said second coil has a space overlapping with a space enclosed by said first coil.

17. An image heating apparatus according to claim 16, wherein the space enclosed by said second coil is present in the space enclosed by said first coil.

18. An image heating apparatus according to claim 16, wherein said first coil extends lengthwise in a direction orthogonal to a moving direction of the recording material, and said second coil is provided at an end portion of said first coil in a longitudinal direction thereof.

19. An image heating apparatus according to claim 16, further comprising switching means connected said electrically conductive line to make the electrically conductive line an open circuit or closed circuit.

20. An image heating apparatus according to claim 16, further comprising a back up member forming a nip with said heat generating member, wherein the recording material bearing an unfixed image at the nip portion is pinched and conveyed, and the unfixed image is fixed on the recording material by the heat of said heat generating member.

* * * * *

UNITED STATES PATENT AND TRADEMARK OFFICE

CERTIFICATE OF CORRECTION

PATENT NO. : 6,246,843 B1
DATED : June 12, 2001
INVENTOR(S) : Hideo Nanataki et al.

It is certified that error appears in the above-identified patent and that said Letters Patent is hereby corrected as shown below:

Title page,
Item [57] ABSTRACT,
Line 2, "has" should read -- has a --.

Column 1,
Line 30, "is come" should read -- comes --.

Column 2,
Line 64, "view" should read -- views --.

Column 3,
Line 16, "FIG. 11" should read -- FIG. 11A --.
Line 60, "the" should read -- and the --.

Column 7,
Line 56, "an" should read -- the --.

Column 8,
Line 12, "$6x10^4$" should read -- $6x10^{-4}$ --.

Column 10,
Line 18, "extremely" should read -- extreme --.
Line 21, "destroy" should read -- destroying --.
Line 38, "(unit;" should read -- (unit: --.

Column 12,
Line 13, "he" should read -- the --.

Column 19,
Line 29, "process" should read -- process that --.

Column 22,
Line 40, "is" should read -- becomes --.
Line 41, "small." should read -- smaller. --.
Line 49, "is great." should read -- becomes greater --.
Line 62, "is" should be deleted.
Line 63, "come" should read -- comes --.

UNITED STATES PATENT AND TRADEMARK OFFICE

CERTIFICATE OF CORRECTION

PATENT NO. : 6,246,843 B1
DATED : June 12, 2001
INVENTOR(S) : Hideo Nanataki et al.

It is certified that error appears in the above-identified patent and that said Letters Patent is hereby corrected as shown below:

Column 23,
Line 15, "line" should read -- line; --.
Line 16, "connected;" should be deleted.

Column 24,
Line 22, "said" should read -- to an --.

Signed and Sealed this

Twelfth Day of March, 2002

*Attest:*

*Attesting Officer*

JAMES E. ROGAN
*Director of the United States Patent and Trademark Office*